US005461470A

United States Patent [19]

De Cock et al.

[11] Patent Number: 5,461,470

[45] Date of Patent: Oct. 24, 1995

[54] ELECTROSTATOGRAPHIC SINGLE-PASS MULTIPLE STATION PRINTER FOR FORMING IMAGES ON A WEB

[75] Inventors: Etienne M. De Cock; Lucien A. De Schamphelaere, both of Edegem; Rudy D. Leroy, Mechelen; Bart J. Van Dessel, St-Antonius, all of Belgium

[73] Assignee: Xeikon NV, Mortsel, Belgium

[21] Appl. No.: 257,116

[22] Filed: Jun. 8, 1994

[30] Foreign Application Priority Data

Jun. 18, 1993 [EP] European Pat. Off. ..... 93304772
Apr. 5, 1994 [EP] European Pat. Off. ..... 94302399

[51] Int. Cl.[6] ..... G03G 15/01

[52] U.S. Cl. ..... 355/326 R; 101/180; 355/319

[58] Field of Search ..... 355/308–310, 355/317, 319, 321, 326 R, 327; 101/180

[56] References Cited

U.S. PATENT DOCUMENTS

| | | | |
|---|---|---|---|
| 3,694,073 | 9/1972 | Bhagat | 355/210 |
| 4,188,110 | 2/1980 | Stange | 355/212 |
| 4,731,631 | 3/1988 | Monkelbaan et al. | 355/256 |
| 4,935,785 | 6/1990 | Wildi et al. | 355/290 |
| 4,968,993 | 11/1990 | Wolfberg et al. | 346/160 |
| 5,031,530 | 7/1991 | Burger | 101/180 X |
| 5,331,890 | 7/1994 | Miyoshi et al. | 101/180 X |

FOREIGN PATENT DOCUMENTS

| | | |
|---|---|---|
| 0154695 | 9/1985 | European Pat. Off. . |
| 60-169862 | 9/1985 | Japan . |

OTHER PUBLICATIONS

"Method for Duplex Printing on Continuous Web Paper" by Edward C. McIrvine; Xerox Disclosure Journal; vol. 9, No. 3, May/Jun. 1984, pp. 201–203.

*Primary Examiner*—William J. Royer
*Attorney, Agent, or Firm*—Brumbaugh, Graves, Donohue & Raymond

[57] ABSTRACT

An electrostatographic single-pass multiple station (e.g. multi-colour) duplex printer is described for forming an image onto a web. The printer has at least three toner image-producing electrostatographic stations. Each station has a rotatable endless surface in the form of a photoconductive drum onto which a toner image can be formed. The printer also includes drive rollers for conveying the web in succession past the stations. Corona discharge devices transfer the toner image on each rotatable surface onto the web. The image-producing stations are arranged in two sub-groups, the drum of one sub-group forming a backing roller for the other sub-group, and vice-versa, thereby to enable simultaneous duplex printing.

26 Claims, 19 Drawing Sheets

Fig. 3B-1
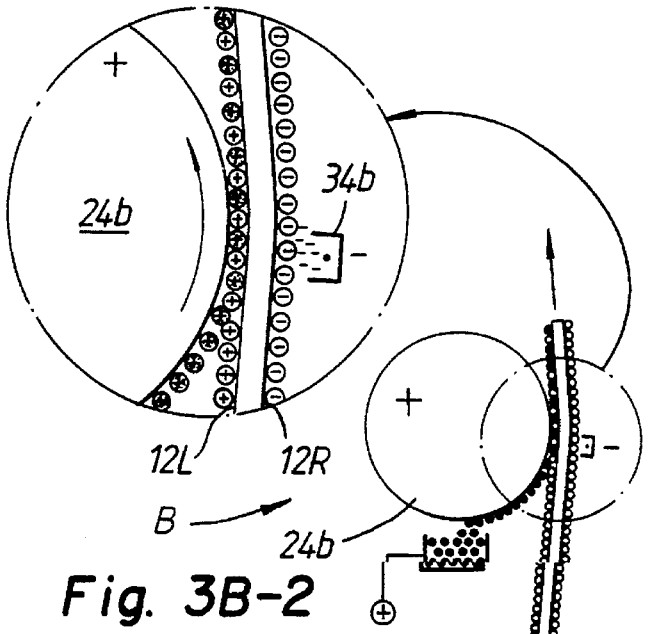
Fig. 3B-2
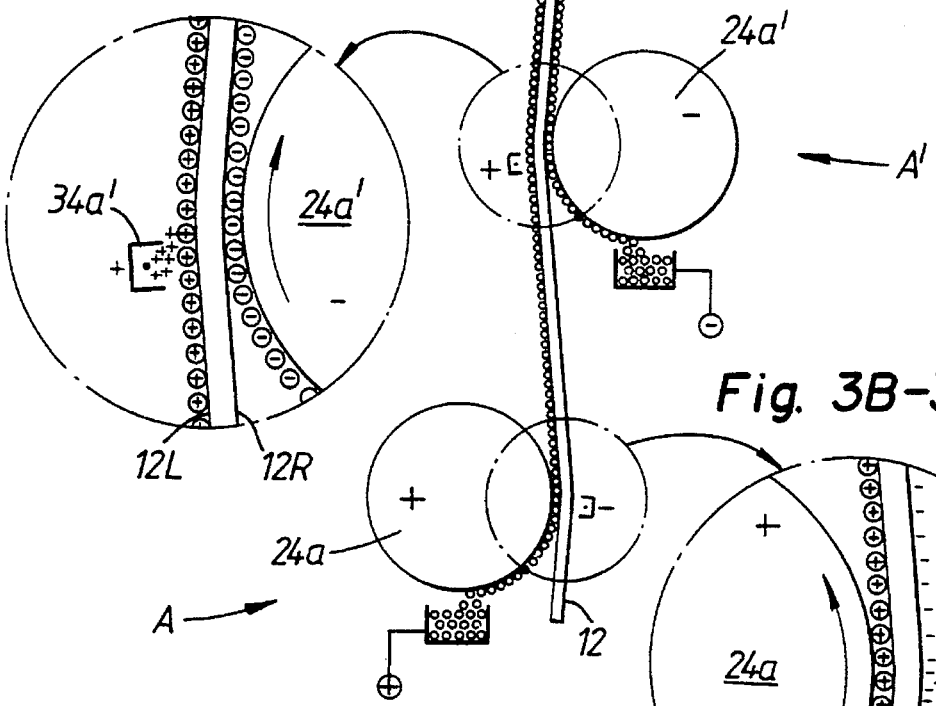
Fig. 3B-3
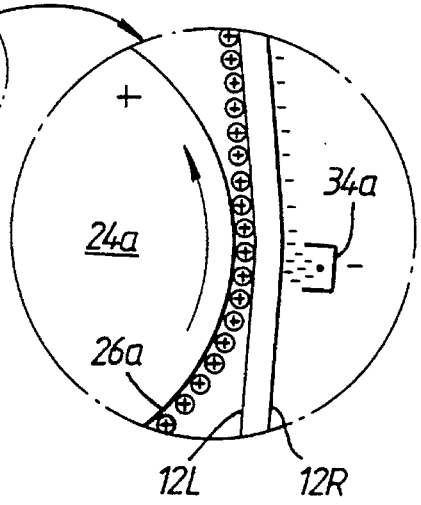
Fig.3B

ELECTROSTATOGRAPHIC SINGLE-PASS MULTIPLE STATION PRINTER FOR FORMING IMAGES ON A WEB

FIELD OF THE INVENTION

The present invention relates to an electrostatographic single-pass multiple station duplex printer for forming images onto a web, in particular but not exclusively to a multi-colour printer for printing onto a paper web, and especially such a printer as is capable of printing colour images for professional purposes as a cost effective alternative to conventional printing of short to medium sized runs.

BACKGROUND TO THE INVENTION

The need for duplex printing from both practical and economic points of view has long been recognized and in classical printing with liquid printing ink, as eg in offset printing of books and journals, duplex printing is common practice.

Electrostatographic printing is based on the image-wise formation of an electrostatic latent image that is developed with electrostatically attractable colorant particles, called toner particles, whereupon the toner image is transferred to the printing stock material, usually paper.

Electrostatographic printing operates according to the principles and embodiments of non-impact printing as described, eg in Principles of Non-Impact Printing by Jerome L. Johnson—Palatino Press—Irvine, Calif., 92715 USA). Electrostatographic printing includes electrographic printing in which an electrostatic charge is deposited image-wise on a dielectric recording member as well as electrophotographic printing in which an overall electrostatically charged photoconductive dielectric recording member is image-wise exposed to conductivity-increasing radiation producing thereby a "direct or reversal mode" toner-developable charge pattern.

By "direct development mode" in electrophotography is meant that toner is electrostatically deposited on the non-photo-exposed areas, whereas in "reversal development mode" toner is electrostatically deposited on the photo-exposed areas. In the last-mentioned development mode a development electrode biased with a charge polarity the same as the polarity of the toner particles ensures that the toner particles are deposited in the photo-exposed areas.

Reversal development mode is not only of interest when negative originals have to be reproduced as positive prints, but likewise when the exposure source is modulated to expose the photoconductor in correspondence with the "black" information to be printed and not in correspondence with the large blank areas of graphic art originals such as printed pages. In that way the exposure source such as a modulated laser source or light-emitting diode array (LED) exposure source controlled normally by a digital electrical signal pattern corresponding with the information to be copied or printed is less loaded.

As used herein, the term "electrostatographic" also includes the direct image-wise application of electrostatic charges on an insulating support, for example by ionography.

Several techniques are known for forming duplex images on a final support medium such as a web or copy sheet. A survey of such techniques is given in U.S. Pat. No. 4,095,979 (Di Francesco et al assigned to Eastman Kodak Company), which relates in particular to duplex copying by means of a photoconductive recording member.

Although most electrophotographic copiers have the capability of reproducing information on both sides of a copy sheet it is not an easy result to accomplish.

In a non-complicated embodiment described in U.S. Pat. No. 3,645,615 (Spear assigned to Xerox Corporation), the copy sheet is redirected into the feed tray of the machine after the first side of the original has been copied to receive a print of the second side of the original on the still blank side. Special paper sheet feed systems have been developed to enable duplex printing at both sides of copy sheets (see for example U.S. Pat. No. 4,095,979 (assigned to Agfa-Gevaert NV).

High volume double side printing (duplex printing) as, eg, in classical offset printing, proceeds on web-type flexible material, normally a roll-fed paper web, which following duplex printing is usually cut into sheets.

In duplex printing on web-type material likewise reversing or turner mechanisms are applied for reversing the web and feeding it into a next printing station [see for example "The Printing Industry" by Victor Strauss, published by Printing Industries of America Inc, 20 Chevy Chase Circle, NW, Washington, D.C. 20015 (1967), p 512–514]. The turnaround of the web to be printed requires an additional roller mechanism and lengthens the part of the printing web residing in the printing machine. Moreover, printing machines operating with web turner mechanisms require more space on the floor of the printing room.

The above cited problems become still more serious the larger the number of printing stations, as is the case in full colour printing operating with three subtractive colour ink printers (yellow, magenta and cyan) and a black printer.

Single-pass colour electrostatographic printers operating with colour printer and black printer stations are described, eg, in U.S. Pat. No. 4,734,788 (Emmett et al assigned to Benson Inc), U.S. Pat. No. 5,027,258 (Tomkins et al assigned to Colorocs Corporation), U.S. Pat. No. 5,160,946 (Hwang assigned to Xerox Corporation) and published PCT patent application WO 92/00645 (Eastman Kodak Company). From these documents can be learned that accurate electrostatographic full colour printing is very complicated.

An example of an electrophotographic duplex printer operating with only two photoconductive rotatable recording drums and single web-type toner receptor material is described in U.S. Pat. No. 3,694,073 (Bhagat assigned to Xerox Corporation). For the exposure of the drums the different sides of an original are illuminated simultaneously and the image-wise modulated light of each side of the original strikes its own photoconductive drum, whereupon the charge image on each drum is toner-developed and the resultant toner images are transferred on opposite sides of the receptor web. According to FIG. 1 of Bhagat, after the first toner image is transferred onto said web the web is moved under a fuser which acts to partially fuse or fix the transferred image upon the web. It has been mentioned that said fusing is optional and preferably incomplete in order that the web be sufficiently cool so as not to adversely affect the transfer of toner to the opposite side. With full fusing the web would have to be quickly cooled before the next toner image is transferred but this requires in practice the lengthening of the path of travel between the fuser and the next corona transfer device.

A problem with non-fused toner on one side of the receptor web passing a next toner-transfer station for attracting a toner image on the other (opposite) side of said web is in that said non-fused toner receives from the corona transfer device a charge opposite to its original triboelectric charge. This will not harm when either in "direct" or "reversal" development mode only two imaging stations with their associated toner-development and toner-transfer stations are used as is the case in the method for duplexing according to said U.S. Pat. No. 3,694,073. However, in multiple colour duplex printing operating with at least three imaging stations in staggered position with respect to the receptor web, an already developed and transferred toner image that has obtained reversed polarity by a transfer corona used for attracting a next toner image to the other side of the web will when coming into close proximity or contact with a next imaging member having a charge opposite in polarity to said toner image become attracted to said member and released from the receptor web whereon it had to stay. However, as the charged toner particles of the first colour on one face of the web reach the oppositely charged drum at the next image-producing station, they are attracted thereto, encouraged by the repulsive force generated by the transfer corona device at that next image-producing station and the already image-wise deposited toner particles are removed from the paper surface. The removal of toner particles in this manner causes a loss of colour density in the final print and a displacement of toner particles may occur at colour boundaries.

SUMMARY OF THE INVENTION

It is an object of the present invention to provide an electrostatographic duplex printing apparatus in which toner images are transferred onto both sides of a receptor web without use of a web-reversing mechanism as is common in double side printing.

In particular, it is an object of the present invention to provide an electrostatographic single-pass multiple station printer for simultaneously forming images on both sides of a web, which is compact in design, has a shorter web path through the printer and enables easy front-to-back registration of images.

According to the invention there is provided an electrostatographic single-pass multiple station printer for forming images on a web, which printer comprises:

at least three toner image-producing electrostatographic stations each having rotatable endless surface means onto which a toner image can be formed;

means for conveying the web in succession past said stations;

transfer means for transferring the toner image on each rotatable surface means onto the web, wherein the image-producing stations are arranged in two sub-groups, the rotatable surface means of one sub-group being staggered with respect to the rotatable surface means of the other sub-group, thereby to enable simultaneous duplex printing.

In such an arrangement image(s) are transferred to a first side of the web by one or more image-producing stations, image(s) are then transferred to the opposite side of the web by one or more further image-producing stations and thereafter further image(s) are formed on the first side of the web again by one or more still further image-producing stations. Such an arrangement is referred to as a "staggered" arrangement.

The most preferred embodiment of a staggered arrangement is where the image-producing stations are located one by one alternately on opposite sides of the web.

The stations are arranged in two sub-groups, the rotatable surface means of one sub-group forming guide roller means for defining a wrapping angle of the web about the rotatable surface means of the other sub-group, and vice-versa.

The electrostatographic single-pass multiple station printer according to this preferred embodiment of the invention has the advantage that no intermediate image-fixing on the web is necessary. Since image-fixing may involve heating of the web, followed by cooling, distortion of the web may not be easily avoided and such distortion can lead to image mis-registration.

While the toner image on the endless surface means may be transferred to the web by other means, such as an opposed hot roller or pressure roller, we prefer to use a corona discharge device as the transfer means. This has the advantage that, at least partly, the adherent contact between the web and the endless surface means comes from the transfer corona discharge device providing electrostatic adhesion between the web and the endless surface means.

The transfer means may be in the form of a corona discharge device which sprays charged particles having a charge opposite to that of the toner particles. The supply current fed to the corona discharge device is preferably within the range of 1 to 10 μμA/cm web width, most preferably from 2 to 5 μA/cm web width, depending upon the paper characteristics and will be positioned at a distance of from 3 mm to 10 mm from the path of the web.

We prefer that the printer further comprises means for controlling the electrostatic charge polarity and preferably also the potential of the toner already present on the web in advance of the third and each subsequent image-producing station, to enable the transfer of a toner image at the third and any subsequent image-producing station without disturbing the image transferred to the same side of the web at a previous image-producing station.

When the image-producing stations are located alternately on opposite sides of the web, and the toner images transferred to the web in each image-producing station have the same charge polarity, we prefer that there is provided between neighbouring image-producing stations from the second image-producing station onwards, means for restoring the polarity of the toner image already deposited on one side of the web before arriving at a following image-producing station after having passed the corona transfer means of the preceding image-producing station.

Preferably, the means for restoring the polarity of the toner image comprises a corona charging device. The corona charging device sprays charged particles such as positive or negative ions or electrons, onto the toner-laden paper web side. According to one embodiment, at the other side of the web an earthed electrode in the form of a wire or plate is present. According to another embodiment, opposite to said corona charging device spraying polarity restoring charges towards said toner image, a DC counter-corona of opposite polarity is present. An AC corona charging device may be used for spraying charges towards said toner image but must have a net charging output of a polarity equal to the original charge polarity of the toner. An AC corona for mainly spraying negative charges is combined with a DC current positive corona at the opposite side of the web. Where an AC corona is used, a suitable AC frequency is from 10 to 100 Hz, depending on the displacement speed of the web. By restoring the initial polarity of the toner as described above, the toner images at opposite sides of the web attract each other electrostatically, having the web in between. Thereby there is no need to provide a fixing device between each image-producing station.

The supply current fed to the corona discharge device for restoring the toner polarity is preferably within the range of 1 to 10 μA/cm web width, most preferably from 2 to 5 μA/cm web width, depending upon the paper characteristics and will be positioned at a distance of from 3 mm to 10 mm from the path of the web.

In a preferred embodiment, an alternating current corona is provided beyond the DC corona transfer means to discharge the web and thereby allow the web to become released from the rotatable endless surface means.

In order to fix the toner image on the web, it is preferred to use a non-contact radiant heated fixing device.

According to a preferred embodiment of the invention, the printer comprises a far infra-red radiant heating means for fixing the toner images after the transfer thereof to both sides of the web.

In preferred embodiments of the invention, the rotatable endless surface means comprises a drum or belt. In the following general description, reference is made to a drum, but it is to be understood that such references are also applicable to endless belts or to any other form of endless surface means. The toner image can be generated on the surface of a first drum and then transferred to the surface of a second drum, so that the second drum acts as an intermediate member, such as described in Offset Quality Electrophotography by L. B. Schein & G. Beardsley, Journal of Imaging Science and Technology, Vol. 37, No. 5 (1993),—see page 459. However, we prefer that the toner image is formed directly on the surface of a drum. To this end, the drum preferably has a photoconductive surface and each toner image-producing electrostatographic station preferably comprises means for charging the surface of the drum, and usually the surface of the drums at all the image-producing stations are charged to the same polarity. Using photoconductors of the organic type, it is most convenient to charge the surface of the drums to a negative polarity and to develop the latent image formed thereon in reversal development mode by the use of a negatively charged toner.

A toner image-producing electrophotographic station preferably comprises:

means for charging the surface of the photoconductive drum or belt;

means for image-wise exposing the charged surface of the drum or belt; and a development station for depositing toner onto the photo-discharged areas of the surface of the drum or belt. In this manner development in the reversal development mode is achieved. Using photoconductors of the organic type, it is most convenient to charge the surface of the drums to a negative polarity and to develop the latent image formed thereon in reversal development mode by the use of a negatively charged toner.

The means for image-wise exposing the charged surface of the drum or belt may comprise an array of image-wise modulated light-emitting diodes or may be in the form of a image-wise modulated scanning laser beam.

The toner will usually be in dry particulate form, but the invention is equally applicable where the toner particles are present as a dispersion in a liquid carrier medium or in a gas medium in the form of an aerosol.

According to one embodiment, the developer contains (i) toner particles containing a mixture of a resin, a dye or pigment of the appropriate colour and normally a charge-controlling compound giving the desired triboelectric charge polarity to the toner, and (ii) carrier particles charging the toner particles by frictional contact therewith. The carrier particles may be made of a magnetizable material, such as iron or iron oxide, to form a magnetic brush of magnetically attracted toner-laden carrier particles. The toner particles are charged and are attracted to the latent image on the drum surface by the electric field between the drum surface and the developer so that the latent image becomes visible.

Preferably, the stations of each sub-group are arranged in a substantially vertical or horizontal configuration. An advantage of the vertical configuration is that the printer occupies very little floor space, ie it has a small footprint. Further, in a vertical configuration the effects of gravity on the web path in the printer are significantly reduced. With either a vertical or a horizontal configuration it is possible to arrange for the components of all image-forming stations to be identical (except for the colour of the toner), leading to operational and servicing advantages.

The printer will usually further comprise a cutting station for cutting the printed web into sheets and preferably the heating means for fixing the toner image transferred on the web is positioned in advance of the cutting station.

In preferred embodiments of the invention, the printer further comprises means for conveying the web under tension past the image-producing stations in synchronism with the rotation of the rotatable surface means. In particular, the electrostatic adhesion created by the transfer means, the wrapping angles and the web tension are such that adherent contact of the web with the endless surface means is capable of allowing the moving web to control the rotation speed of the endless surface means.

By stating that the adherent contact of the web with the endless surface means is capable of allowing the moving web to control the rotation speed of the surface means, we mean that the only torque, or substantially the only torque, which is applied to the endless surface means is derived from the adherent contact between the web and the endless surface means. As explained further below, since no other, or substantially no other, resultant force is acting upon the endless surface means, the endless surface means is constrained to rotate in synchronism with the web. Slippage between the endless surface means and the web is thereby eliminated.

It is convenient for each image-producing station to comprise a driven rotatable magnetic developing brush and a driven rotatable cleaning brush, both in frictional contact with the endless surface means. We have found that by arranging for the developing brush and the cleaning brush to rotate in opposite senses, it can be assured that the resultant torque applied by the brushes to the endless surface means is at least partly cancelled out. In particular, we prefer that the extents of frictional contact of the developing brush and the cleaning brush with the endless surface means are such that the resultant torque transmitted to the endless surface means is substantially zero. By stating that the resultant torque transmitted to the endless surface means is substantially zero is meant that any resultant torque acting upon the endless surface means is smaller than the torque applied by the web to the endless surface means. Ideally, the position of at least one of the brushes relative to the endless rotatable surface means is adjustable thereby to adjust the extent of frictional contact between that brush and the endless surface means.

In one embodiment of the invention, the web is a final support for the toner images and is unwound from a roll, fixing means being provided for fixing the transferred images on the web. In this embodiment, the printer may further comprise a roll stand for unwinding a roll of web to be printed in the printer, and a web cutter for cutting the printed web into sheets. The drive means for the web may comprise one or more drive rollers, preferably at least one drive roller being positioned downstream of the image-producing stations and a brake or at least one drive roller being positioned upstream of the image forming stations. The speed of the web through the printer and the tension therein is dependent upon the torque applied to these drive rollers.

For example, one may provide two motor driven drive rollers, one driven at constant speed defining the web speed and the other driven at constant torque defining the web tension. Preferably the web is conveyed through the printer at a speed of from 5 cm/sec to 50 cm/sec and the tension in the web at each image-producing station preferably lies within the range of 0.2 to 2.0N/cm web width.

The rotatable surface means of adjacent image-producing stations may be positioned to define a wrapping angle of at least 5°, preferably from 10° to 20°. The use of the optimum wrapping angle is important, not only for ensuring that the movement of the web controls the peripheral speed of the drum in synchronism therewith, but also to improve the quality of image transfer from the drum surface to the web by avoiding jumping of toner particles from the drum surface to the web which would be liable to occur in the case of tangential contact between the web and the drum, and which could result in a loss of image quality. The wrapping angle should also preferably be sufficient that, where a corona device is used as the transfer means, the web is in contact with the drum over the whole width of the flux angle of the transfer corona.

The printer construction according to the invention is particularly advantageous where the printer is a multi-colour printer comprising magenta, cyan, yellow and black printing stations.

In duplex printing on web-type material, reversing or turner mechanisms may be desirable for reversing the web and feeding it into a next printing station—see for example "The Printing Industry" by Victor Strauss, published by Printing Industries of America Inc, 20 Chevy Chase Circle, NW, Washington, D.C. 20015 (1967), p 512–514. The turnaround of the web to be printed requires an additional turnaround mechanism containing one or more reversing rollers. However, it is difficult to maintain image quality when a toner-laden web comes with one or both of its toner-laden sides into contact with a reversing roller, or other contact roller, before sufficient fixing of the roller-contacting toner image has taken place.

According to preferred embodiments of the invention, we therefore provide the printer with a rotatable contact roller for contacting the web while it has an electrostatically charged toner particle image on at least that surface thereof which is adjacent said contact roller, wherein in that said contact roller is associated with electrostatic charging means capable of providing on the surface of said contact roller an electrostatic charge having the same polarity as the charge polarity of the toner particles on the adjacent surface of said web before contact of said receptor material with the surface of said contact roller.

Thus the quality of a toner image is practically not impaired by contact of the web through its non-fixed or incompletely fixed toner particles with a contact roller surface before complete fixing of the toner image.

We prefer that the contact roller is also associated with cleaning means for removing any toner particles from the surface of said roller after release of the receptor material from the surface of said contact roller.

While this feature of the invention may be applied to a contact roller in the form of a web transport roller, a guiding roller, a cold pressure roller or a hot pressure roller, we have found that this arrangement is particularly beneficially applicable to the contact roller being a reversing roller. Where the contact roller is a reversing roller, the wrapping angle of the web about the roller will be greater than 90°. It is possible for a number of reversing rollers to be provided in series, in which case the total of the wrapping angles about these rollers will be greater than 90°.

The contact roller preferably comprises an electrically insulating surface coating. We prefer that this surface coating is smooth and in particular comprises an abhesive material. When the contact roller has an electrically insulating surface, said electrostatic charging means may suitably comprise a corona charge device arranged for directing its corona flux to the electrically insulating surface of the contact roller, said contact roller being earthed or at a fixed potential with respect to said corona charge device. As an alternative, the electrostatic charging means may be a brush in contact with the contact roller, relative movement between the brush and the roller surface causing the generation of electrostatic charge on the surface of the contact roller.

The cleaning means is preferably located upstream of said charging means, considered in the direction of rotation of the contact roller. The cleaning means may include a cleaning brush capable of rotating in the same rotational sense as the contact roller. A scraper device may alternatively be used as the cleaning means.

A pair of corona charge devices may be located upstream of said contact roller, one on either side of the web path to ensure that the toner particles on opposite sides of the web carry opposite electrostatic charges.

In a preferred construction, a direct current charge corona is arranged for directing its corona charge flux towards the web in the zone wherein the web contacts the surface of the contact roller, and an alternating current corona device is arranged for directing its corona discharge flux towards the web substantially at the position where said web leaves the surface of the contact roller.

PREFERRED EMBODIMENTS OF THE INVENTION

The invention will now be further described, purely by way of example, with reference to the accompanying drawings in which:

FIGS. 3 and 4 are incomplete.

FIG. 3B is similar to FIG. 3, but shows the printer utilising opposite drum and toner polarities at adjacent printing stations.

FIG. 8A shows the offset table, scheduler, encoder and web position counter; and FIG. 8B shows the comparator and image transfer station A.

In the description which follows, the formation of images by the "reversal" development mode is described. One skilled in the art will appreciate however, that the same principles can be applied to "direct" development mode image forming.

Figure 1:
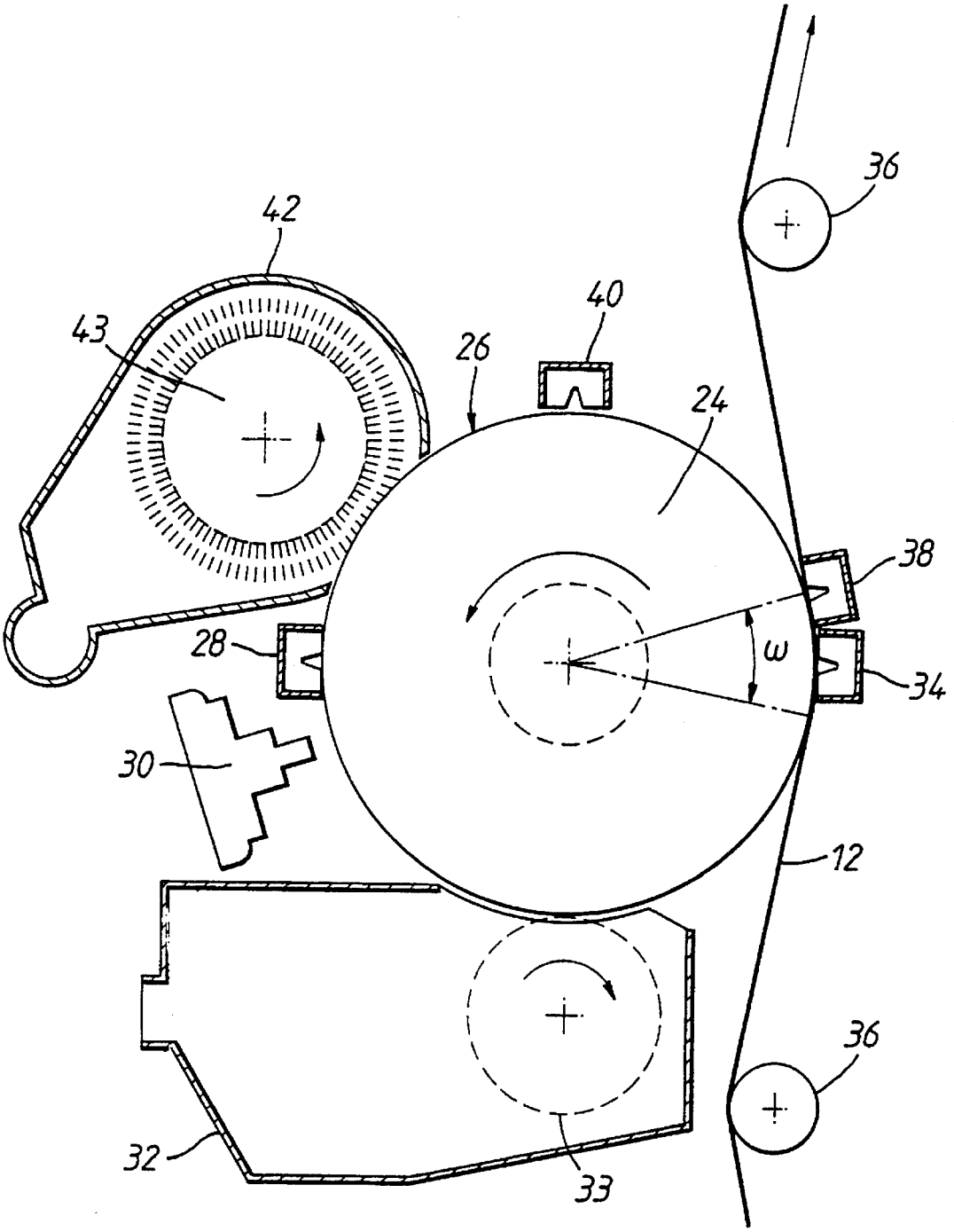
FIG. 1 shows in detail a cross-section of one of the print stations of the duplex printer shown in FIG. 2.

As shown in FIG. 1, each image-producing station comprises a cylindrical drum 24 having a photoconductive outer surface 26. Circumferentially arranged around the drum 24 there is a main corotron or scorotron charging device 28 capable of uniformly charging the drum surface 26, for example to a potential of about −600 V, an exposure station 30 which may, for example, be in the form of a scanning laser beam or an LED array, which will image-wise and line-wise expose the photoconductive drum surface 26 causing the charge on the latter to be selectively dissipated, for example to a potential of about −250 V, leaving an image-wise distribution of electric charge to remain on the drum surface 26. This so-called "latent image" is rendered visible by a developing station 32 which by means known in the art will bring a developer in contact with the drum surface 26. The developing station 32 includes a developer drum 33 which is adjustably mounted, enabling it to be moved radially towards or away from the drum 24 for reasons as will be explained further below. According to one embodiment, the developer contains (i) toner particles containing a mixture of a resin, a dye or pigment of the appropriate colour and normally a charge-controlling compound giving the desired triboelectric polarity to the toner, and (ii) carrier particles charging the toner particles by frictional contact therewith. The carrier particles may be made of a magnetizable material, such as iron or iron oxide. In a typical construction of a developer station, the developer drum 33 contains magnets carried within a rotating sleeve causing the mixture of toner and magnetizable carrier particles to rotate therewith, to contact the surface 26 of the drum 24 in a brush-like manner. Negatively charged toner particles, triboelectrically charged to a level of, for example 9 μC/g, are attracted to the photo-exposed areas on the drum surface 26 by the electric field between these areas and the negatively electrically biased developer so that the latent image becomes visible.

After development, the toner image adhering to the drum surface 26 is transferred to the moving web 12 by a transfer corona device 34. The moving web 12 is in face-to-face contact with the drum surface 26 over a wrapping angle ω of about 15° determined by the position of guide rollers 36. The transfer corona device, being on the opposite side of the web to the drum, and having a high potential opposite in sign to that of the charge on the toner particles, attracts the toner particles away from the drum surface 26 and onto the surface of the web 12. The transfer corona device typically has its corona wire positioned about 7 mm from the housing which surrounds it and 7 mm from the paper web. A typical transfer corona current is about 3 mA/cm web width. The transfer corona device 34 also serves to generate a strong adherent force between the web 12 and the drum surface 26, causing the latter to be rotated in synchronism with the movement of the web 12 and urging the toner particles into firm contact with the surface of the web 12. The web, however, should not wrap around the drum beyond the point dictated by the positioning of a guide roller 36 and there is therefore provided circumferentially beyond the transfer corona device 34 a web discharge corona device 38 driven by alternating current and serving to discharge the web 12 and thereby allow the web to become released from the drum surface 26. The web discharge corona device 38 also serves to eliminate sparking as the web leaves the surface 26 of the drum.

Thereafter, the drum surface 26 is pre-charged to a level of, for example −580 V, by a pre-charging corotron or scorotron device 40. The pre-charging makes the final charging by the corona 28 easier. Any residual toner which might still cling to the drum surface may be more easily removed by a cleaning unit 42 known in the art. Final traces of the preceding electrostatic image are erased by the corona 28. The cleaning unit 42 includes an adjustably mounted cleaning brush 43, the position of which can be adjusted towards or away from the drum surface 26 to ensure optimum cleaning. The cleaning brush is earthed or subject to such a potential with respect to the drum as to attract the residual toner particles away from the drum surface. After cleaning, the drum surface is ready for another recording cycle.

Figure 2:
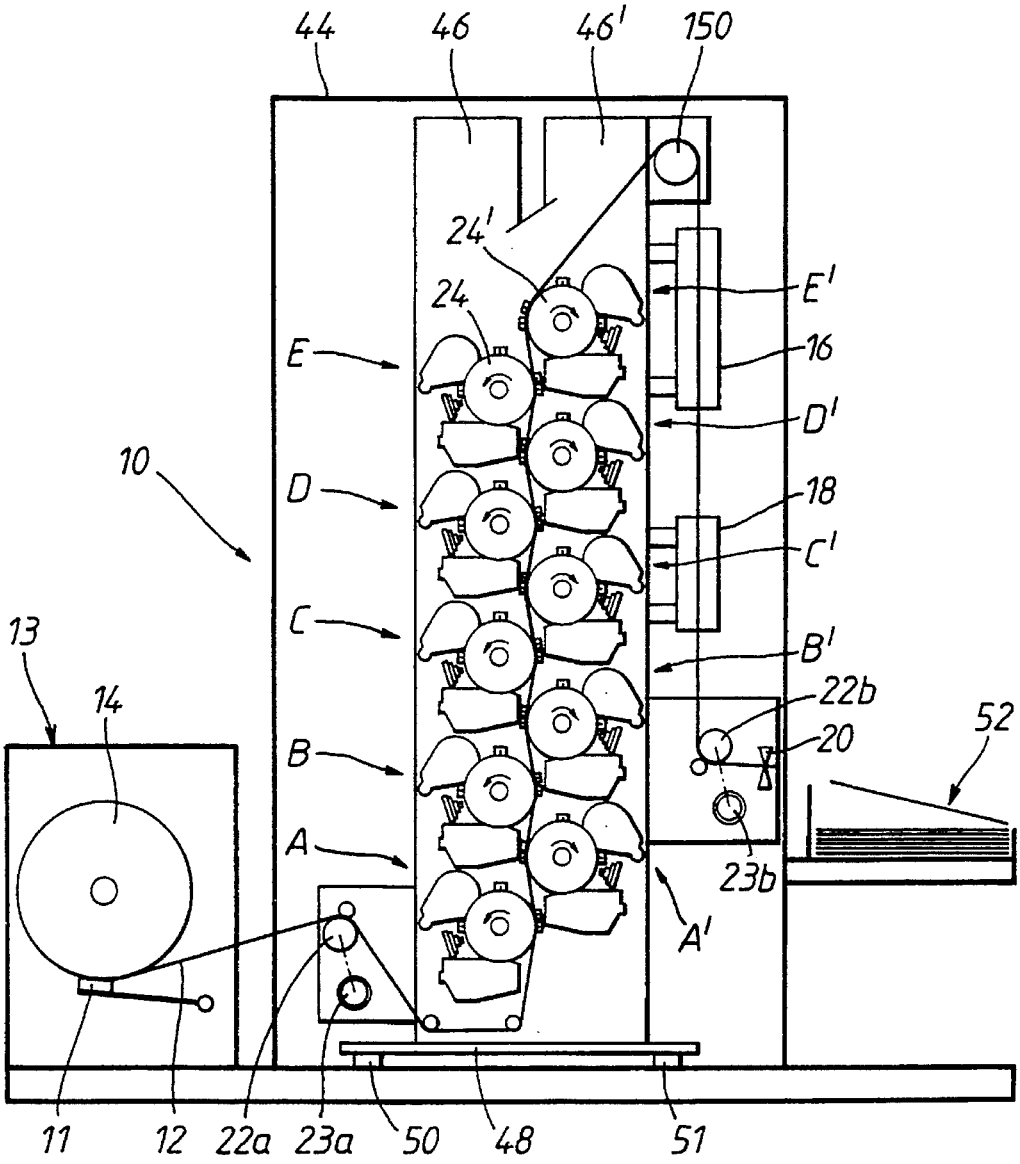
FIG. 2 shows a section of a printer according to an embodiment of the invention, capable of simultaneous duplex printing.

Referring to both FIGS. 1 and 2, after passing the first printing station A (of a printer 10—see FIG. 2), the web passes successively to image-producing stations B, C and D, where images in other colours are transferred to the web. It is critical that the images produced in successive stations be in register with each other. In order to achieve this, the start of the imaging process at each station has to be critically timed. However, accurate registering of the images is possible only if there is no slip between the web 12 and the drum surface 26.

The electrostatic adherent force between the web and the drum generated by the transfer corona device 34, the wrapping angle ω determined by the relative position of the drum 24 and the guide rollers 36, and the tension in the web generated by the drive roller 222 and the braking effect of the brake 11 are such as to ensure that the rotational speed of the drum 24 is determined substantially only by the movement of the web 12, thereby ensuring that the drum surface moves synchronously with the web.

The cleaning unit 42 includes a rotatable cleaning brush 43 which is driven to rotate in a sense the same as that of the drum 24 and at a peripheral speed of, for example twice the peripheral speed of the drum surface. The developing unit 32 includes a brush-like developer drum 33 which rotates in the opposite sense to that of the drum 24. The resultant torque applied to the drum 24 by the rotating developing brush 33 and the counter-rotating cleaning brush 43 is adjusted to be close to zero, thereby ensuring that the only torque applied to the drum is derived from the adherent force between the drum 24 and the web 12. Adjustment of this resultant force is possible by virtue of the adjustable mounting of the cleaning brush 43 and/or the developing brush 33 and the brush characteristics.

The printer 10 according to the invention has a supply station 13 in which a roll 14 of web material 12 is housed, in sufficient quantity to print, say, up to 5,000 images. The web 12 is conveyed into a tower-like printer housing 44 in which support columns 46 and 46' are provided, each housing five similar printing stations A to E and A' to E'. The image-producing stations A, B, C and D and likewise A', B', C' and D' are arranged to print yellow, magenta, cyan and black images respectively. The stations E and E' are provided in order to optionally print an additional colour, for example a specially customised colour, for example white. Each sub-group of printing stations A to E and A' to E' are mounted in a substantially vertical configuration resulting in a reduced footprint. The columns 46 and 46' may be mounted against vibrations by means of a platform 48 resting on springs 50, 51. The columns 46 and 46' may be mounted on rails enabling their relative movement. In this way the columns may be moved away from each other for servicing purposes.

Figure 2A:
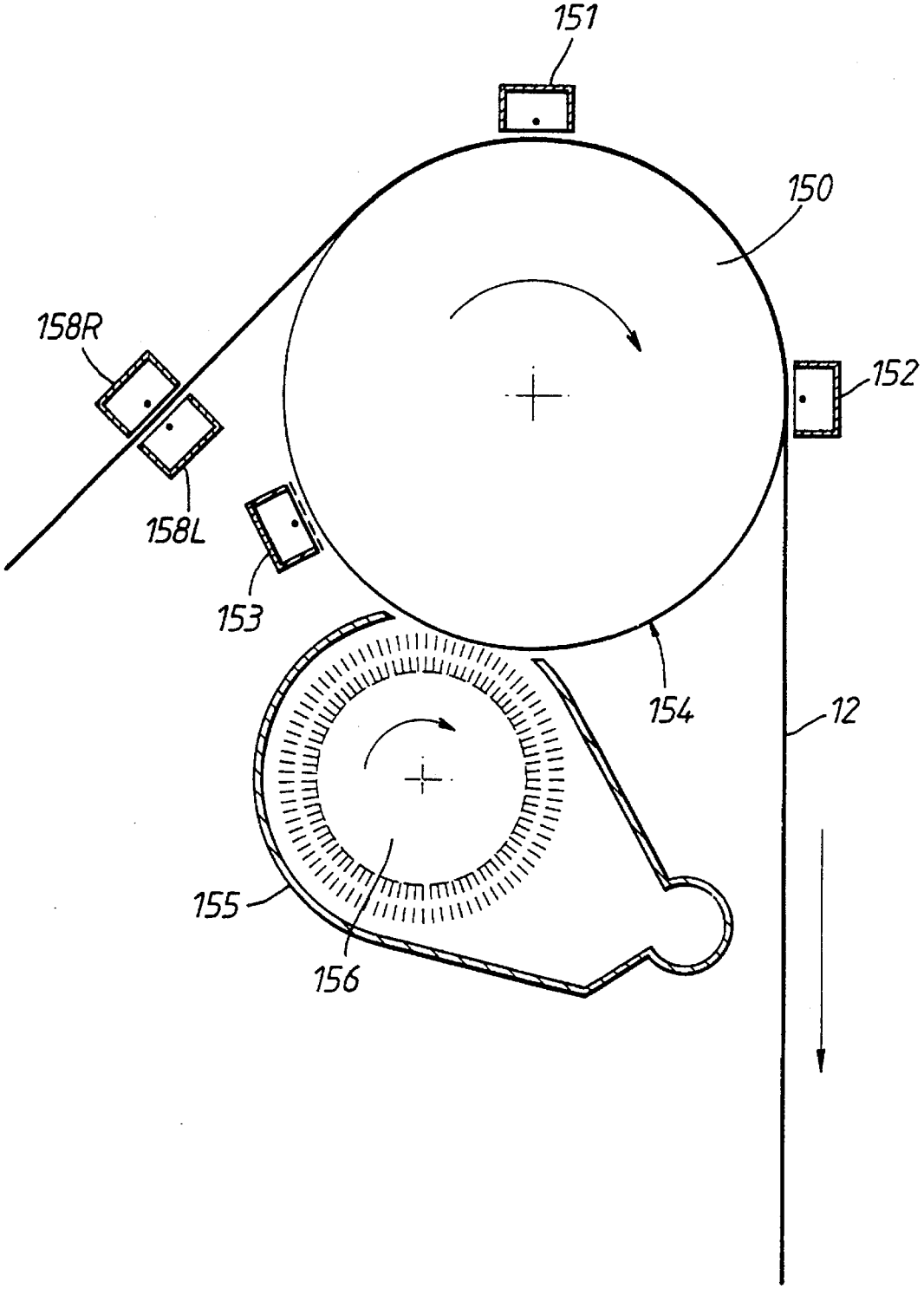
FIG. 2A shows a reversing roller for use with a printer as shown in FIG. 2, the reversing roller being arranged in conjunction with several means for counteracting toner image distortion on a web before final fixing of the toner particles on said web.
Figure 2B:
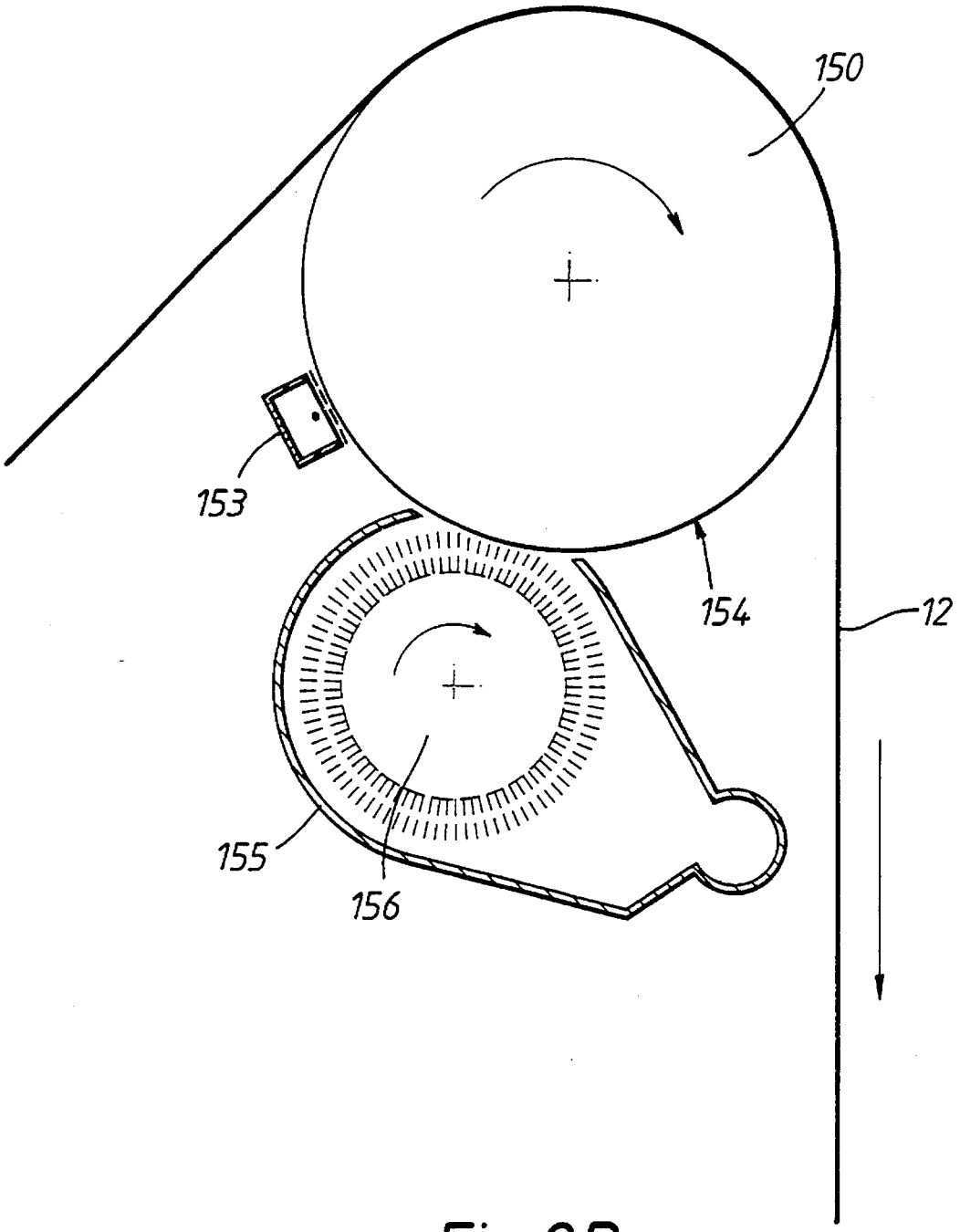
FIG. 2B shows a reversing roller arranged in conjunction with a simpler arrangement of means for counteracting toner image distortion on a web before final fixing of the toner particles on said web.

After leaving the final image-producing station E', the path of the web 12 is reversed by the reversing roller 150, which is associated with means illustrated in FIGS. 2A and 2B for counteracting toner-deposition on the surface thereof. The image on the web is fixed by means of the image-fixing station 16, optionally followed by a web-cooling station 18, and fed to a cutting station 20 (schematically represented) and a stacker 52 if desired.

The web 12 is conveyed through the printer by two drive rollers 22*a*, 22*b* one positioned between the supply station 13 and the first image-producing station A and the second positioned between the image-fixing station 16 and the cutting station 20. The drive rollers 22*a*, 22*b* are driven by controllable motors, 23*a*, 23*b*. One of the motors 23*a*, 23*b* is speed controlled at such a rotational speed as to convey the web through the printer at the required speed, which may for example be about 125 mm/sec. The other motor is torque controlled in such a way as to generate a web tension of, for example, about 1N/cm web width.

The columns 46 and 46' are mounted closely together so that the web 12 travels in a generally vertical path defined by the facing surfaces of the imaging station drums 24, 24'. This arrangement is such that each imaging station drum acts as the guide roller for each adjacent drum by defining the wrapping angle. In the particular embodiment of FIG. 2, there is no need for an intermediate image-fixing station. The paper web path through the printer is short and this gives advantages in that the amount of paper web which is wasted when starting up the printer is small. By avoiding the use of intermediate fixing, front-to-back registration of the printed images is made easier. Although in FIG. 2 the columns 46 and 46' are shown as being mounted on a common platform 48, it is possible in an alternative embodiment for the columns 46 and 46' to be separately mounted.

As shown in more detail in FIG. 2A, in the printer shown in FIG. 2, the receptor material web 12 moves along a web transport path over a freely rotatable reversing roller 150. The reversing roller 150 has an electrically conductive core and is coated with an electrically insulating material, preferably a smooth and abhesive material, such as a highly fluorinated polymer, preferably TEFLON (tradename), allowing electrostatic charging by corona. The roller surface 154 has no or poor adhesion with respect to the toner particles.

The wrapping angle of the web about the reversing roller 150 is about 135°. The web 12 carries an electrostatically charged toner image on both sides thereof. The linear movement of web 12 is maintained in synchronism with the peripheral speed of the surface of the reversing roller 150 by virtue of the fact that the latter is freely rotatable. A potential difference between the roller 150 and the web 12 is obtained by means of corona charging device 151 driven by direct current. The web 12 is therefore electrostatically attracted over the contacting zone of web and roller, so that the roller 150, being at a fixed potential, preferentially at earth potential, is driven by web 12 and no slippage takes place, so that no smearing of the toner image could take place.

A discharging corona device 152 operated with alternating current, enables easy release of the web 12 from the roller surface 154.

According to the embodiment illustrated in FIG. 2A, upstream of the reversing roller 150 the web 12 passes between a pair of corona charge devices 158R, 158L of opposite polarity. Hereby, the toner particles carried on the outer surface of the web 12, which surface does not contact the reversing roller 150, obtain a polarity the same as the polarity of the corona charge flux of the corona 151.

While the pair of corona devices 158L, 158R may be constituted by DC coronas of opposite polarity, however, since a negative DC corona tends to produce a non-uniform discharge along its length, it is advantageous to replace in said pair the negative DC corona by an AC corona device. This AC corona in combination with a positive DC corona at the opposite side of the paper web 12 produces a net negative charge that is more uniform.

The transfer of toner particles to the reversing roller 150 that is earthed or at a fixed potential, is counteracted by charging the roller surface 154 with corona 153, preferably a scorotron, before contacting the web 12 carrying the toner images. The charge polarity of said corona 153 is the same as the polarity of the toner particles that will come into contact with the roller surface 154.

Any residual toner that may cling to the roller surface 154 after release of the web 12 from the roller 150, will be removed by means of a cleaning device 155. The cleaning device 155 includes a cleaning brush 156 which rotates in the same rotational sense as the reversing roller 150. The cleaning brush 156 is earthed or subject to such a potential that adhering residual toner particles are attracted away from the roller surface 154.

In the alternative embodiment as shown in FIG. 2B, by sufficiently mechanically tensioning the web 12 on the reversing roller 150, the coronas 151 and 152 providing electrostatic attraction and release between the web and roller may be dispensed with. Further, in case the toner particles that will come into contact with the surface of the reversing roller 150, have a charge level sufficiently high and of opposite polarity to the corona charge of corona device 153, the corona pair 158R, 158L can be left out without giving rise to a significant image smudging by the reversing roller surface 154.

Figures 1, 3:
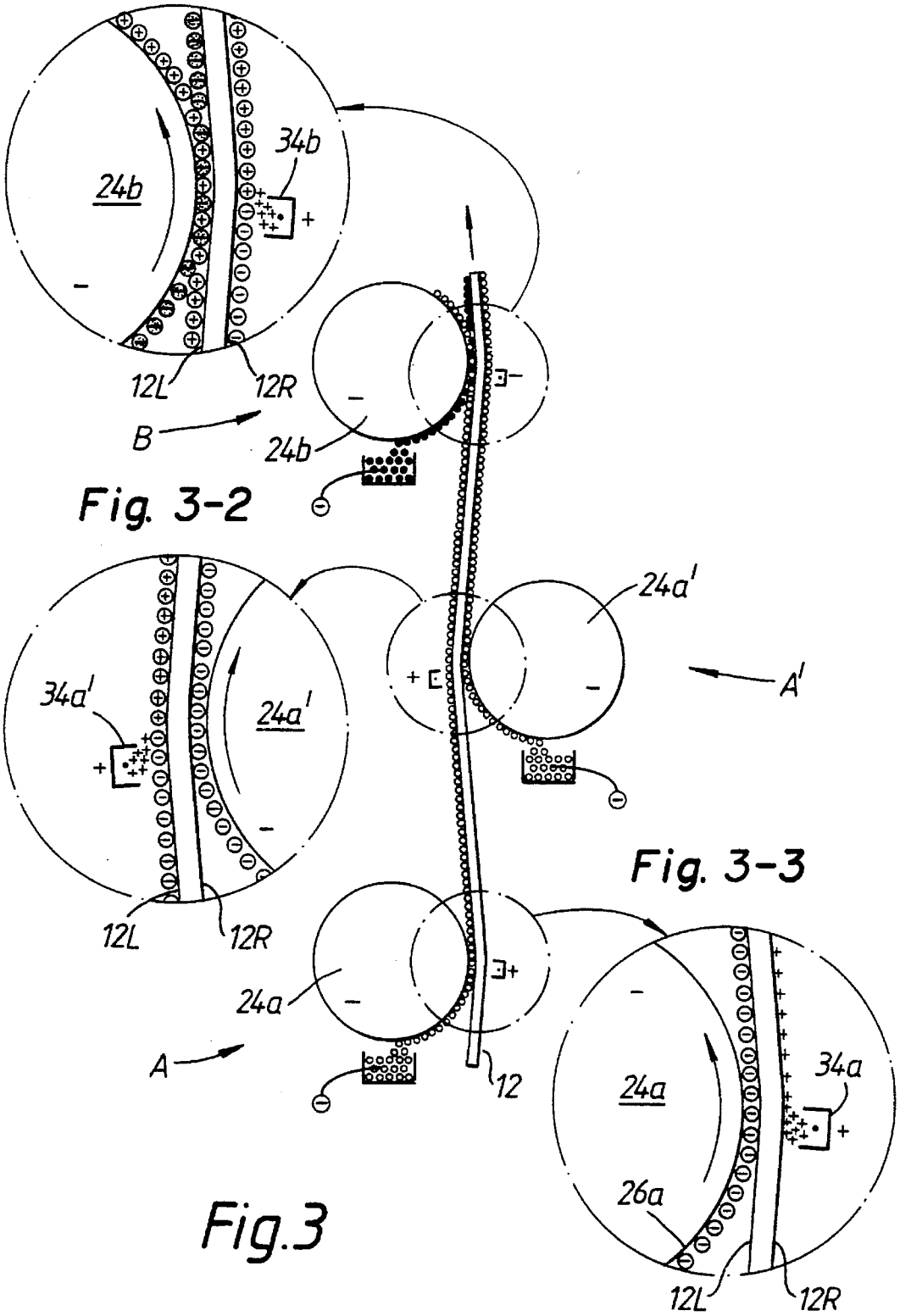
FIGS. 3 and 4 represent diagrammatic cross-sectional views of part of a printer such as that shown in FIG. 2, operating in reversal development mode, these views showing the first three printing stations wherein for comparative purposes

Referring to FIG. 3, there is shown the paper web 12 and the drums 24*a*, 24*a'* and 24*b* of three staggered image-producing stations A, A' and B of the printer shown in FIG. 2, operating in reversal development mode. The transfer corona devices 34*a*, 34*a'* and 34*b* associated with these printing stations are also shown.

Referring to the lower expanded portion of FIG. 3, it can be seen that in the image-producing station A the negatively charged drum 24*a*, carries on its surface 26*a* negatively charged toner particles indicated by open circles. The transfer corona device 34*a* provides a stream of positively charged ions which by virtue of the adjacent negatively charged drum 24*a* are attracted in that direction and are thereby deposited on one face 12R of the paper web 12. The attraction between the positive charges on the face 12R and the negatively charged toner particles of a first colour causes the latter to be deposited upon the face 12L of the paper web 12.

Referring to the central expanded portion of FIG. 3, it can be seen that as the paper web 12 carrying the negatively charged toner particles on the face 12L thereof reaches the image-producing station A', the transfer corona device 34*a'* provides a stream of positively charged ions to be deposited on the face 12L of the paper web 12, causing the charge on the toner particles to reverse to positive. At this point negatively charged toner particles are deposited from the drum 24*a'* onto the face 12R of the paper web 12.

Referring to the upper expanded portion of FIG. 3 it can be seen that as the paper web 12 carrying the positively charged toner particles on the face 12L thereof reaches the image-producing station B, the transfer corona device 34*b* provides a stream of positively charged ions to be deposited on the face 12R of the paper web, causing the charge on the toner particles on that face to reverse to positive. At this point, negatively charged toner particles of a second colour, indicated by filled circles, are deposited from the drum 24*b* onto the face 12L of the paper web 12. However, as the positively charged toner particles of the first colour on the face 12L reach the negatively charged drum 24*b*, they are attracted thereto, encouraged by the repulsive force generated by the transfer corona device 34*b* and are removed from the paper surface. The removal of toner particles in this manner causes a loss of colour density in the final print and a displacement of toner particles may occur at image boundaries.

Figure 4:
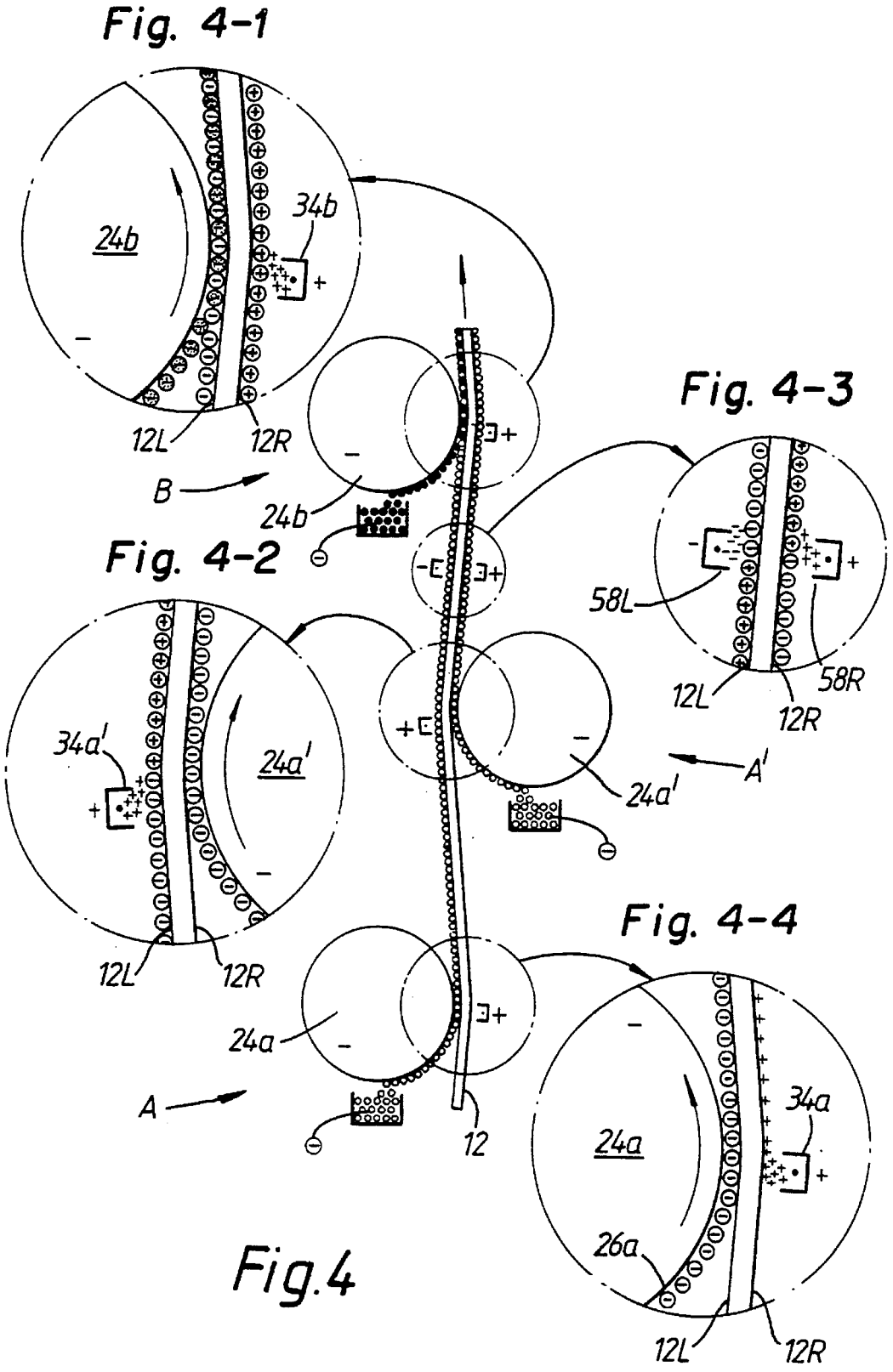

FIG. 4 shows a solution to this problem. In advance of the third image-producing station B and also between each subsequent pair of opposite image-producing stations (not shown) an opposed pair of corona discharge devices 58L and 58R are positioned one on each side of the paper web 12. The polarity of the corona discharge devices 58L and 58R are chosen to reverse the charge carried on the toner particles carried on the adjacent face 12R and 12L respectively of the paper web 12. As will be seen from the expanded portion of FIG. 4, between stations A' and B, the positively charged toner particles on the face 12L of the paper web 12 are reversed to carry a negative charge as they pass the negative corona device 58L, while the negatively charged toner particles on the face 12R of the paper web 12 are reversed to carry a positive charge as they pass the positive corona device 58R. As can be seen from the upper exploded view in FIG. 4, the toner particles of the first colour on the face 12L are now negatively charged as they reach the negatively charged drum 24*b* and they are therefore repelled by the charge on the drum preventing their removal from the paper web, assisted by the positive charges from the transfer corona 34*b*. The paper web therefore continues to the next station in the printer carrying toner particles of both the first and second colours on the face 12L in the desired amounts according to the image to be produced.

Figure 5:
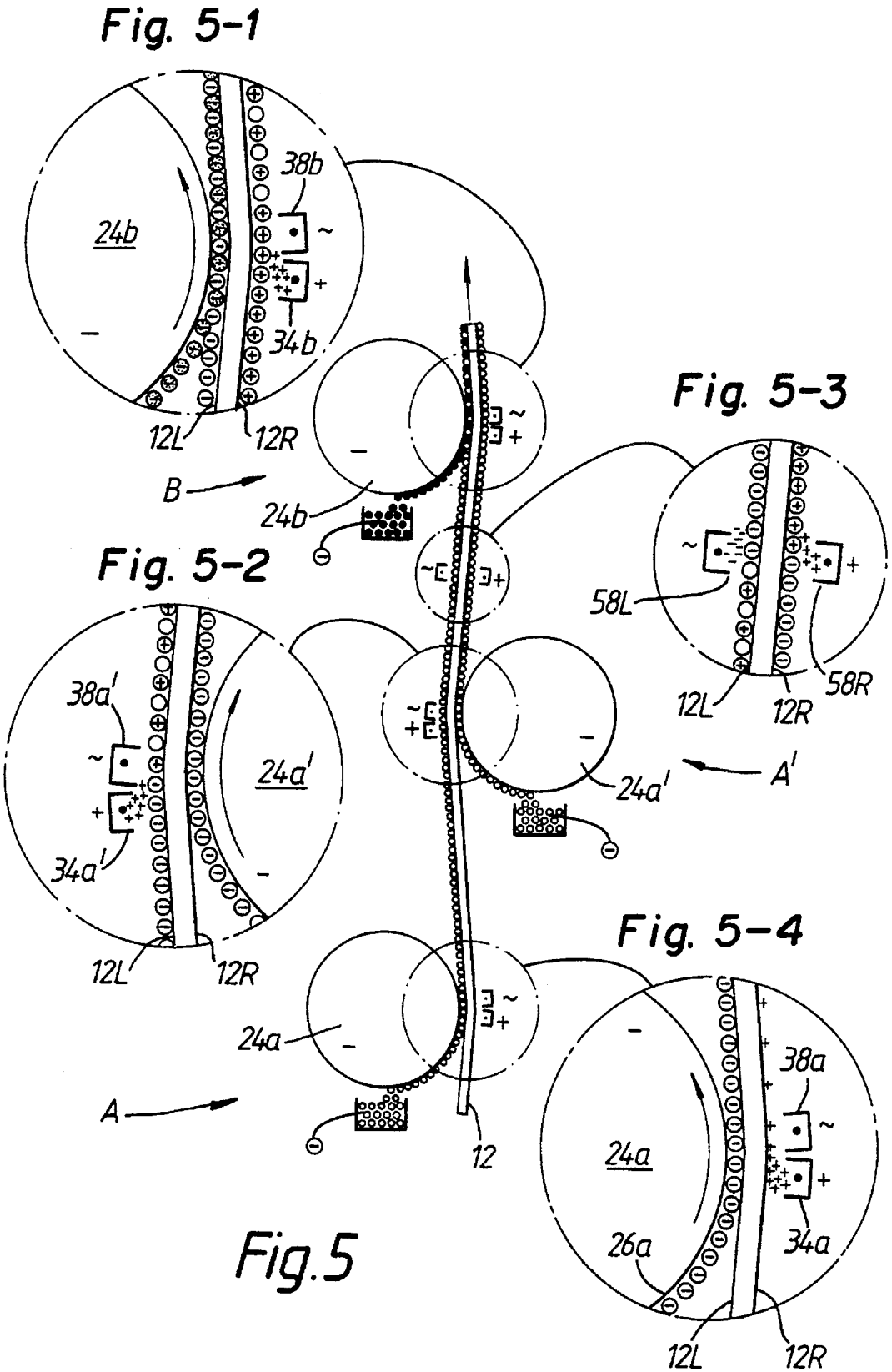
FIG. 5 represents a modification of the view shown in FIG. 4.

FIG. 5 is similar to FIG. 4, but additionally shows the web discharge corona devices 38*a*, 38*a*' and 38*b* associated with each printing station to reduce the positive charges on the adjacent side of the web and prevent sparking in the post-transfer gap between the web and the drum.

In FIG. 4 the corona devices 58L and 58R have been described as DC coronas of opposite polarity. Since a negative DC corona tends to produce a non-uniform discharge along its length it is advantageous to replace this negative DC corona by an AC corona device. This AC corona device (58L) in combination with the positive DC corona device (58R) produces a net negative charge that is more uniform.

Although FIGS. 3, 4 and 5 illustrate "reversal" development mode printing, it will be clear to those skilled in the art that the same general principles can be applied to "direct" development mode printing. Thus, referring to FIG. 3A, there is shown the paper web 12 and the drums 24*a*, 24*a'* and 24*b* of three staggered image-producing stations of the printer shown in FIG. 2, operating in direct development mode. The transfer corona devices 34*a*, 34*a'* and 34*b* associated with these stations are also shown.

Figures 1, 2, 3, 3A:
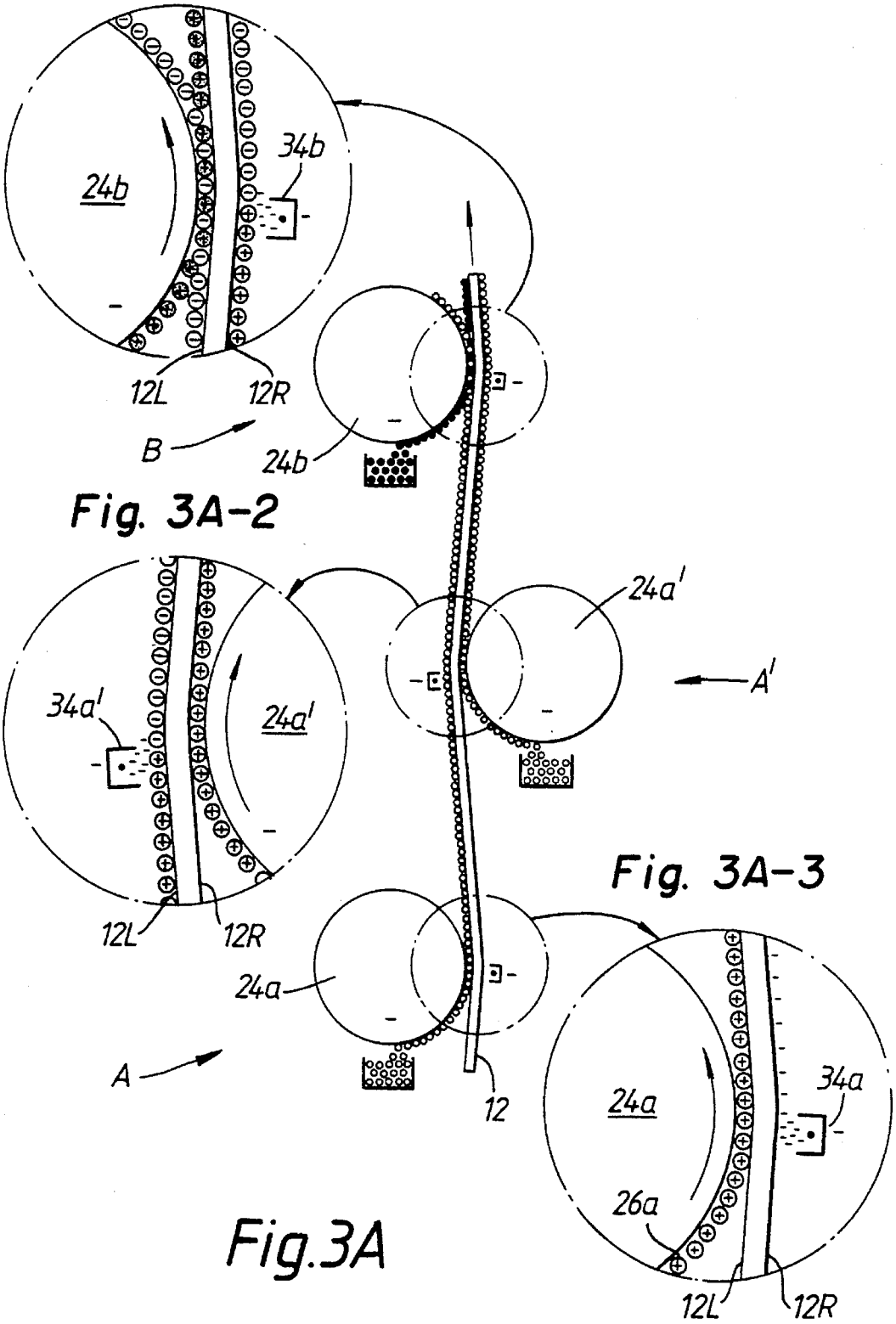
FIGS. 3A, 4A and 5A are similar to FIGS. 3, 4 and 5, but show the printer used in direct development mode.

Referring to the lower expanded portion of FIG. 3A, it can be seen that the negatively charged drum 24*a*, carries on its surface 26*a* positively charged toner particles indicated by open circles. The transfer corona device 34*a* provides a stream of negatively charged ions which by virtue of the adjacent negatively charged drum 24*a* are attracted in that direction and are thereby deposited on one face 12R of the paper web 12. The attraction between the negative charges on the face 12R and the positively charged toner particles of a first colour causes the latter to be deposited upon the face 12L of the paper web 12.

Referring to the central expanded portion of FIG. 3A, it can be seen that as the paper web 12 carrying the positively charged toner particles on the face 12L thereof reaches the image-producing station A', the transfer corona device 34*a'* provides a stream of negatively charged ions to be deposited on the face 12L of the paper web 12, causing the charge on the toner particles to reverse to negative. At this point positively charged toner particles are deposited from the drum 24*a'* onto the face 12R of the paper web 12.

Referring to the upper expanded portion of FIG. 3A it can be seen that as the paper web 12 carrying the negatively charged toner particles on the face 12L thereof reaches the image-producing station B, the transfer corona device 34*b* provides a stream of negatively charged ions to be deposited on the face 12R of the paper web, causing the charge on the toner particles on that face to reverse to negative. At this point, positively charged toner particles of a second colour, indicated by filled circles, are deposited from the drum 24*b* onto the face 12L of the paper web 12. However, as the negatively charged toner particles of the first colour on the face 12L reach the photo-discharged areas of the surface of the drum 24*b*, they are forced thereto, encouraged by the repulsive force generated by the transfer corona device 34*b* and are removed from the paper surface. The removal of toner particles in this manner causes a loss of colour density in the final print and a displacement of toner particles may occur at colour boundaries.

Figure 4A:
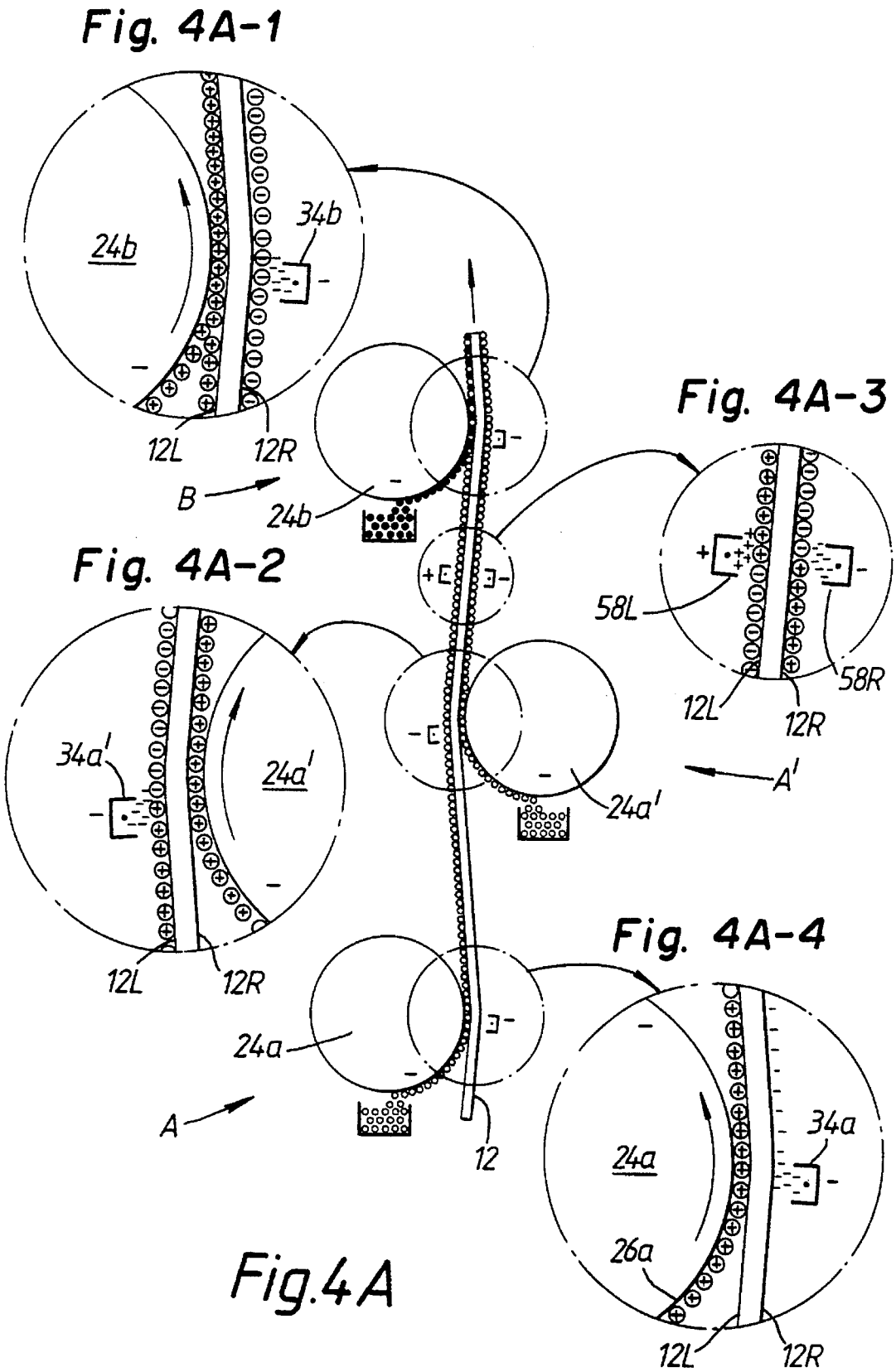

FIG. 4A shows a solution to this problem. In advance of the third image-producing station B and also between each subsequent opposite image-producing station (not shown) a pair of corona discharge devices 58L and 58R of opposite polarity are positioned one on each side of the paper web 12. The polarity of the corona discharge devices 58L and 58R are chosen to reverse the charge carried on the toner particles carried on the adjacent face 12R and 12L respectively of the paper web 12. As will be seen from the expanded portion of FIG. 4A, between stations A' and B, the negatively charged toner particles on the face 12L of the paper web 12 are reversed to carry a positive charge as they pass the positive corona device 58L, while the positively charged toner particles on the face 12R of the paper web 12 are reversed to carry a negative charge as they pass the negative corona device 58R. As can be seen from the upper exploded view in FIG. 4A, the toner particles of the first colour on the face 12L are now positively charged as they reach the image-producing station B and are encouraged by the attractive force generated by the negative transfer corona device 34*b* to be retained on the paper surface. The paper web therefore continues to the next station in the printer carrying toner particles of both the first and second colours on the face 12L in the desired amounts according to the image to be produced.

Figure 5A:
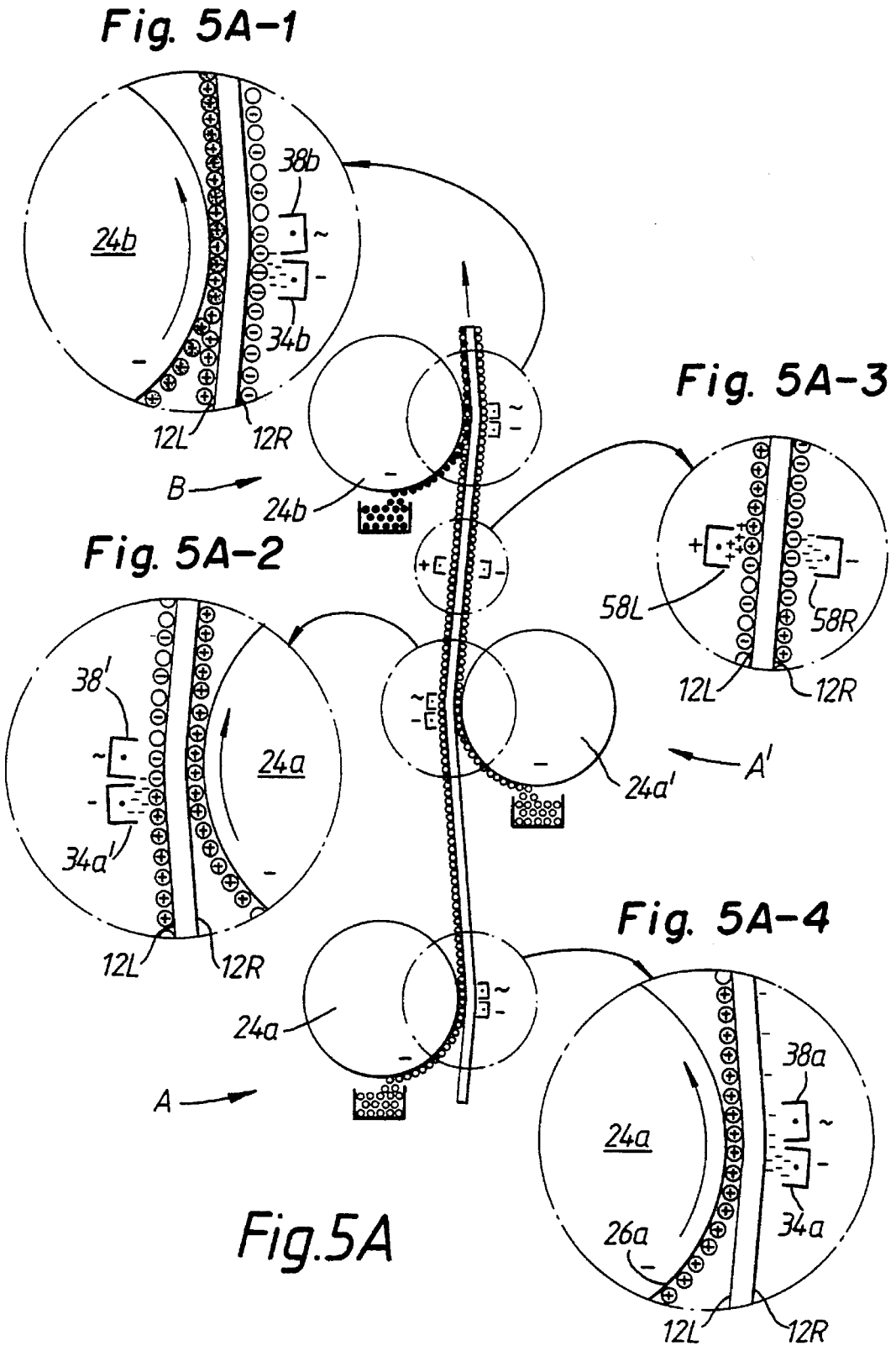

FIG. 5A is similar to FIG. 4A, but additionally shows the web discharge corona devices 38*a*, 38*a*' and 38*b* associated with each printing station.

It is possible to avoid the problems demonstrated in FIGS. 3 and 3A by utilising opposite drum and toner polarities at adjacent printing stations, as shown in FIG. 3B.

Referring to FIG. 3B, there is shown the paper web 12 and the drums 24*a*, 24*a*' and 24*b* of three staggered printing stations of the printer shown in FIG. 2, operating in reversal development mode. The transfer corona devices 34*a*, 34*a*' and 34*b* associated with these printing stations are also shown.

Referring to the lower expanded portion of FIG. 3B, it can be seen that the positively charged drum 24*a*, carries on its surface 26*a* positively charged toner particles indicated by open circles. The transfer corona device 34*a* provides a stream of negatively charged ions which by virtue of the adjacent positively charged drum 24*a* are attracted in that direction and are thereby deposited on one face 12R of the paper web 12. The attraction between the negative charges on the face 12R and the positively charged toner particles of a first colour causes the latter to be deposited upon the face 12L of the paper web 12.

Referring to the central expanded portion of FIG. 3B, it can be seen that as the paper web 12 carrying the positively charged toner particles on the face 12L thereof reaches the image-producing station A', the transfer corona device 34*a*' provides a stream of positively charged ions to be deposited on the face 12L of the paper web 12, causing the charge on the toner particles to be maintained as positive. At this point negatively charged toner particles are deposited from the drum 24*a*' onto the face 12R of the paper web 12.

Referring to the upper expanded portion of FIG. 3B it can be seen that as the paper web 12 carrying the positively charged toner particles on the face 12L thereof reaches the image-producing station B, the transfer corona device 34*b* provides a stream of negatively charged ions to be deposited on the face 12R of the paper web, causing the charge on the toner particles on that face to be maintained as negative. At this point, positively charged toner particles of a second colour, indicated by filled circles, are deposited from the drum 24*b* onto the face 12L of the paper web 12. As the positively charged toner particles of the first colour on the face 12L reach the positively charged drum 24*b*, they are repelled thereby, encouraged by the attractive force generated by the transfer corona device 34*b* and are retained on the paper surface.

The arrangement shown in FIG. 3B is however less preferred since that solution takes away the advantage that components at all printing stations are identical. Also the range of available positive colour toners is more limited than the range of available negative colour toners, which are therefore used throughout the printer for preference.

Figure 6:
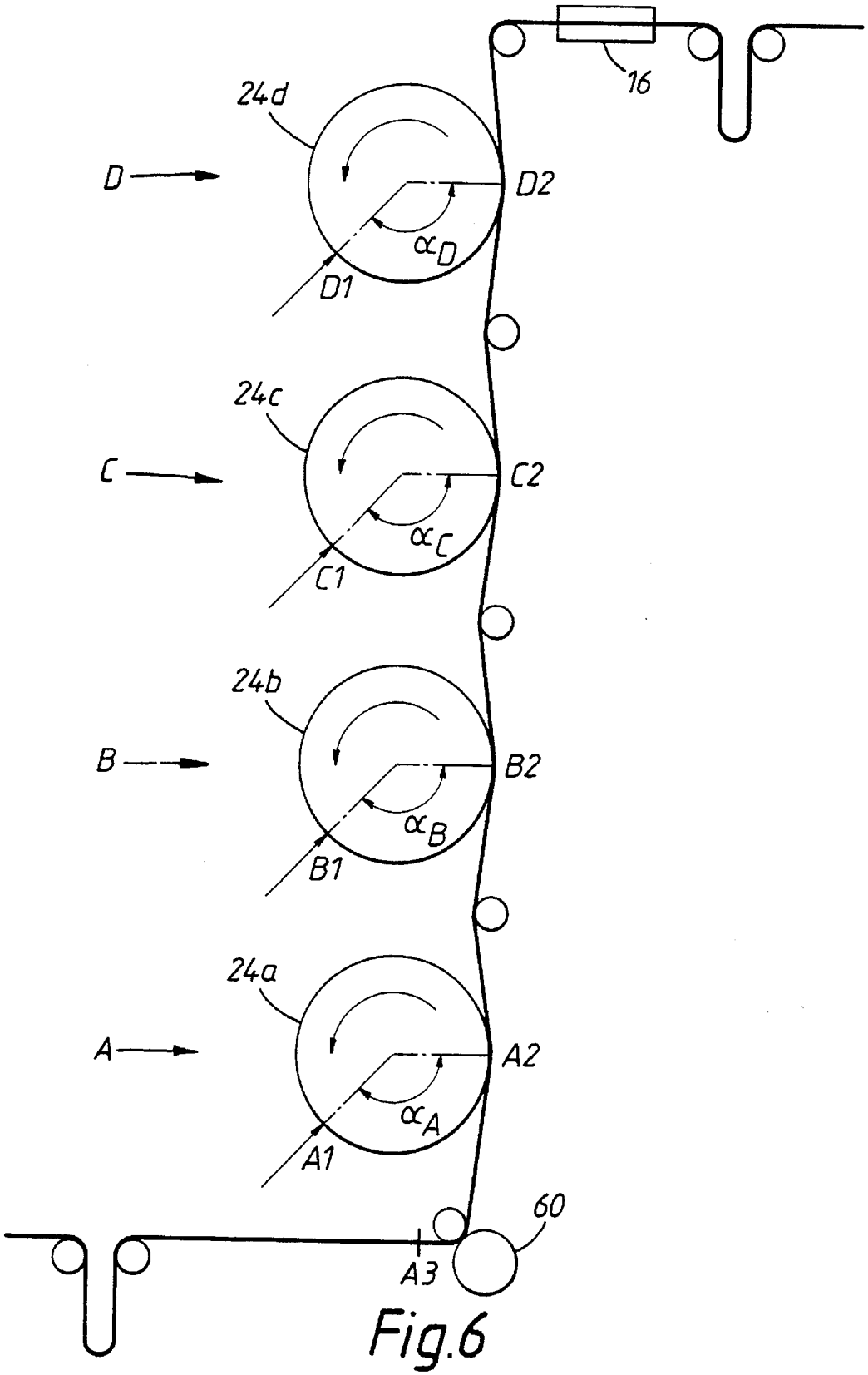
FIG. 6 shows a schematic representation of transferring images in register.

With reference to FIG. 6, and for the purpose of describing the operation of the register control means, we define:

writing points $A_1$, $B_1$, $C_1$ and $D_1$ being the position of the writing stations of the image printing stations A, B, C and D as projected, perpendicular to the drum surface, on the drum surface;

transfer points $A_2$, $B_2$, $C_2$ and $D_2$ being the points on the surface of drums 24*a*, 24*b*, 24*c* and 24*d* that coincide with the centre of the wrapping angle ω (see FIG. 1);

lengths $l_{A2B2}$, $l_{B2C2}$ and $l_{C2D2}$ being the lengths measured along the web between the points $A_2$ and $B_2$, $B_2$ and $C_2$ and $C_2$ and $D_2$;

lengths $l_{A1A2}$, $l_{B1B2}$, $l_{C1C2}$ and $l_{D1D2}$ being the lengths measured along the surface of the drums 24*a*, 24*b*, 24*c* and 24*d* between the points $A_1$ and $A_2$, $B_1$ and $B_2$, $C_1$ and $C_2$ and $D_1$ and $D_2$.

In order to obtain good registration, the delay between writing an image at $A_1$ and writing a related image at $B_1$, $C_1$ or $D_1$ should be equal to the time required for the web to move over a length $l_{AB}$, $l_{AC}$ or $l_{AD}$, wherein:

$$l_{AB}=l_{A1A2}+l_{A2B2}-l_{B1B2} \text{ and consequently}$$

$$l_{AC}=l_{A1A2}+l_{A2B2}+l_{B2C2}-lC1C2 \text{ and}$$

$$l_{AD}=l_{A1A2}+l_{A2B2}+l_{B2C2}+l_{C2D2}-l_{D1D2}$$

In practice the lengths $l_{A1A2}$ etc., and $l_{A2B2}$ etc. will usually be designed to be nominally identical but, due to manufacturing tolerances, minor differences may not be avoided and for the purposes of explaining the principles of registration they are assumed not to be identical.

From the above equations, one derives easily a possible cause of mis-registration, ie that when using a fixed time $$t_{AB}=l_{AB}/v_{average}$$

with which the imaging at point $B_1$ is delayed from the imaging at point $A_1$, while the web speed v shows variations over this period of time, the web will have travelled over a length $$l'_{AB}=\int_0^{t_{AB}} v\,dt.$$

Since it is most likely that $l'_{AB}$ does not equal $l_{AB}$, the image written at point $B_1$ will, when being transferred onto the web, not coincide with the image written at point $A_1$, thus causing mis-registration.

Let $f_E$ be the pulse frequency being generated by the encoder means 60 wherein $f_E$ equals $n \cdot f_D$, n being a whole number; the line frequency $f_D$ being the frequency at which lines are printed ($f_D$=v/d) where d is the line distance.

Each encoder pulse is indicative of unit web displacement (ρ=d/n). The relative position of the web at any time is therefore indicated by the number of pulses z generated by the encoder.

Given that the relative distance l equals the distance over which the web has moved during a given period of time, then:

$$z=l/\rho$$

and, in accordance with the definitions of $l_{AB}$, $l_{AC}$ and $l_{AD}$ above, we can define:

$$z_{AB}=z_{A1A2}+z_{A2B2}-z_{B1B2}$$

$$z_{AC}=\ldots \text{ etc.}$$

Thus, by delaying the writing of an image at point $B_1$ by a number of encoder pulses $z_{AB}$ from the writing of an image at $A_1$, it is assured that both images will coincide when being transferred onto the web. This is so irrespective of any variation in linear speed of the paper web, provided that the drums 24*a* to 24*d* rotate in synchronism with the displacement of the paper web, as described above.

While the encoder 60 is shown in FIG. 6 as being mounted on a separate roller in advance of the printing stations A to D, we prefer to mount the encoder on one of the drums 24*a* to 24*d*, preferably on a central one of these drums. Thus, the web path between the drum carrying the encoder and the drum most remote therefrom is minimized thereby reducing any inaccuracies which may arise from unexpected stretching of the paper web 12, and of variations of $l_{A2B2}$ etc. due to eccentricity of the drums or the guiding rollers, defining the wrapping angle (ω).

A typical optical encoding device would comprise 650 equally-spaced marks on the periphery of a drum having a diameter of 140 mm in the field of vision of a static optical detection device. With a line distance of about 40 μm, this would generate 1 pulse per 16 lines.

Figure 6A:
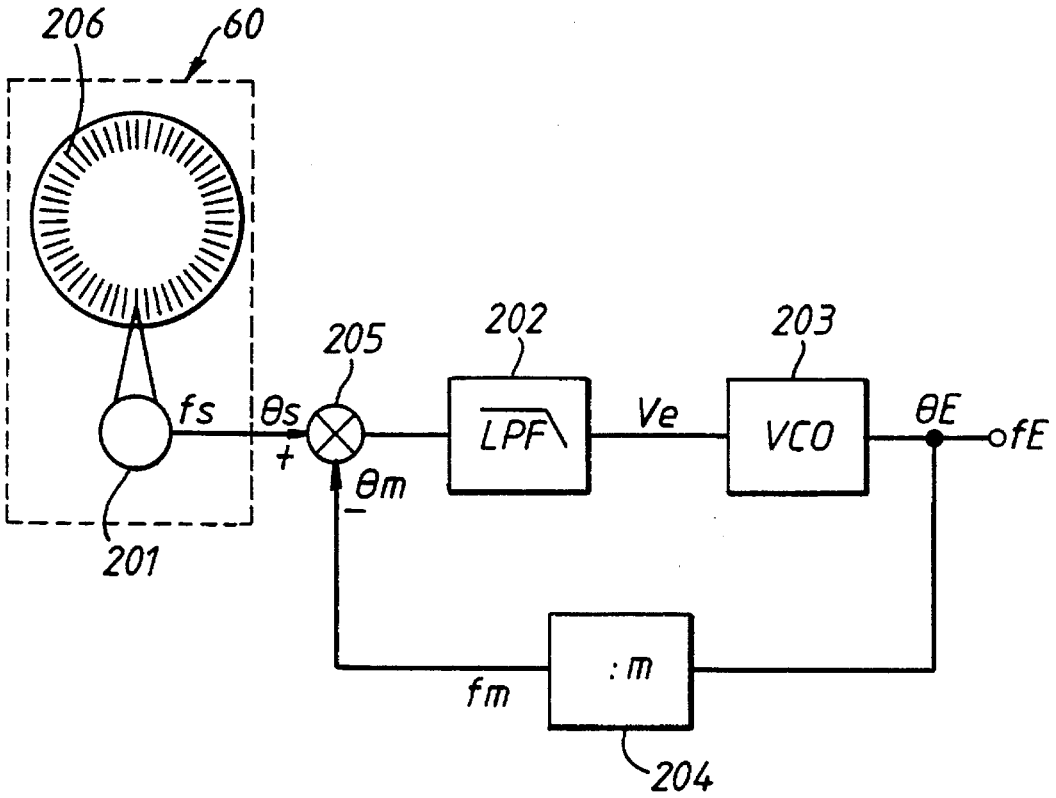
FIG. 6A shows a frequency multiplier circuit for use in a printer according to the invention.

Referring to FIG. 6A, there is shown an encoder 60 comprising an encoder disc 206 together with a frequency multiplier circuit. The frequency multiplier circuit, having very good phase tracking performance, multiplies the input encoder sensor frequency $f_s$ by a constant and integer number m. To obtain good register resolution, m is chosen high enough that $$f_E=mf_s=nf_D$$

thus $$f_s=nf_D/m.$$

It is necessary that $f_s$ is much less than $f_D$ and it therefore follows that m must be much higher than n.

A voltage controlled oscillator 203 generates a square waveform with a frequency $f_E$. This frequency is divided by m in the divider 204 to a frequency $f_m$, from which $\Theta_m$ is compared in phase comparator 205 with the phase $\Theta_s$ of the incoming frequency $f_s$ coming from the encoder sensor 201.

A low pass filter 202 filters the phase difference $\Theta_s-\Theta_m$ to a DC voltage $V_e$ which is fed to the voltage controlled oscillator 203.

With good phase tracking performance, the phase difference between $\Theta_s$ and $\Theta_m$ approaches zero, so that due to the frequency multiplication, there are m times more phase edges on $f_E$ between two encoder sensor input phase edges. Every phase edge of $f_E$ represents a web displacement of d/n.

The low pass filter 202 cancels out the high frequency variations in the encoder signal, which are normally not related to web speed variations but to disturbances caused by vibrations.

The time constant of the low pass filter 202 defines the frequency response of the multiplier so as to realize a cut-off frequency of, for example 10 Hz.

Figure 7:
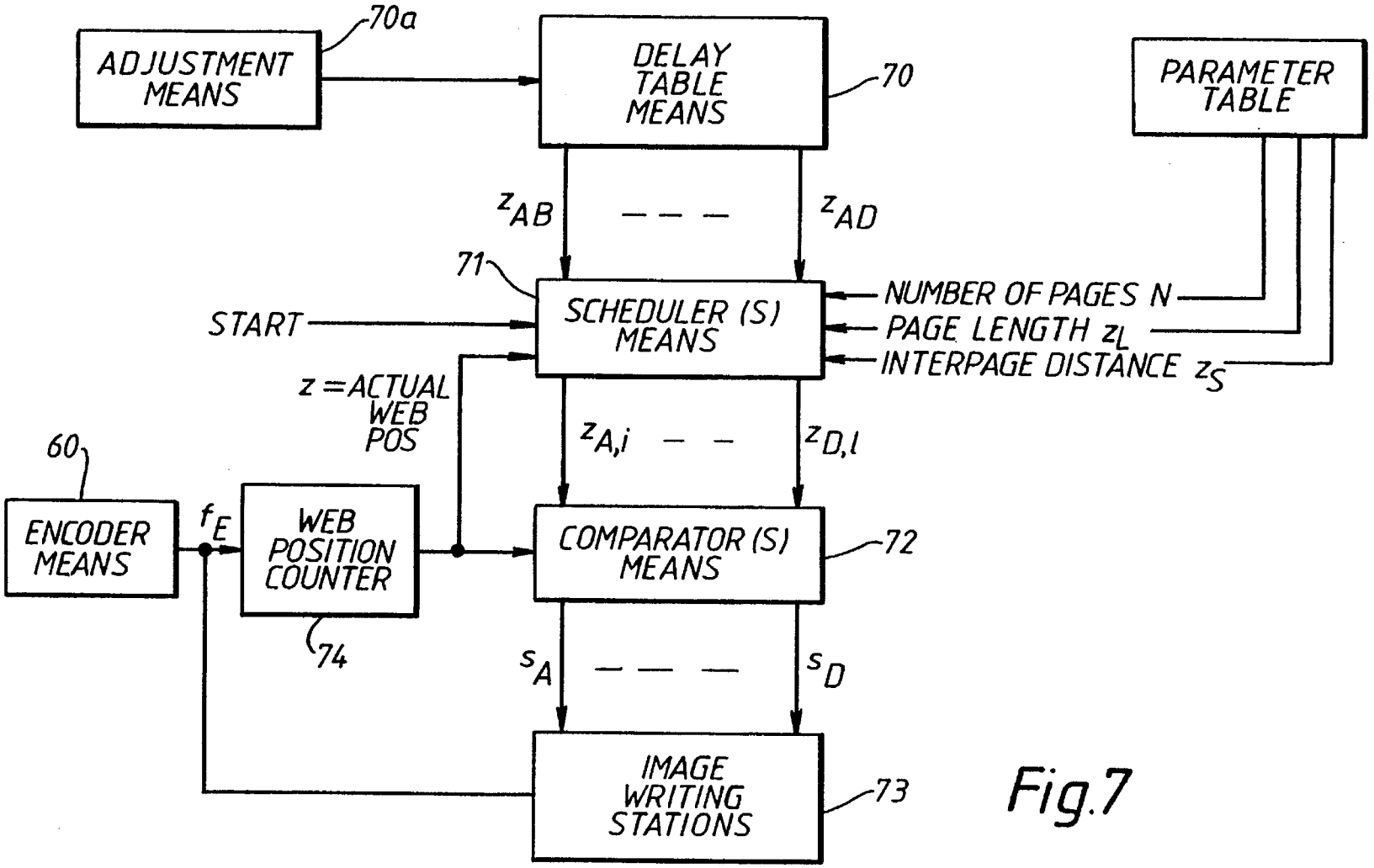
FIG. 7 shows a schematic arrangement of register control means for controlling the registration of images in a printer according to the invention.

Referring to FIG. 7, encoder means 60 generates a signal with frequency $f_E$ being n times higher than the frequency ($f_D$) resulting from encoding the time it takes for the web 12 to advance over a distance equal to the line distance d. For a 600 dpi printer (line distance d=42.3 μm), a web speed of 122.5 mm/s results in a frequency $f_D$=2896 Hz.

A web position counter 74 counts pulses derived from the encoder 60 so that at any time, the output of the counter is indicative of a relative web position z, wherein each increment of z denotes a basic web displacement of ρ being 1/nth of the line distance d.

Delay table means 70 stores the predetermined values $Z_{AB}$, $Z_{AC}$, $Z_{AD}$ equalling the number of basic web displacements to be counted from the start of writing a first image on drum 24*a*, at point A1, to the moment the writing of subsequent images on drums 24*b*, 24*c* and 24*d;* at points B1, C1 and D1, so that the position of all subsequent images on the paper web 12 will correspond exactly to the position of the first image. The adjustment means 70*a* will be discussed further below with reference to FIG. 9.

Scheduler means 71 calculates the values $Z_{A,i}$, $Z_{B,j}$, $Z_{C,k}$ and $Z_{D,l}$; wherein each of these values represent the relative web position at which the writing of the ith, jth, kth and lth image should be started at image writing stations A, B, C and D. Given that values:

N=the number of images to print;

$z_L$=the length of an image expressed as a multiple of basic web displacements; and $z_S$=the space to be provided between two images on paper (also expressed as a multiple of basic web displacements.

The scheduler means can calculate the different values of $z_{A,i}\ldots z_{D,l}$ as follows.

When the START signal (the signal which starts the printing cycle) is asserted, then (assuming the first image is to be started at position $z_0+z_1$, wherein $z_0$ represents the web position at the moment the START signal is asserted):

TABLE 1

| | | |
|---|---|---|
| $z_{A,0}=z_0+z_1$ | $z_{B,0}=z_0+z_{AB}+z_1$ | $\ldots\ z_{D,0}=z_0+z_{AD}+z_1$ |
| $z_{A,1}=z_0+z_L+z_S+z_1$ | $z_{B,1}=z_{A,1}+z_{AB}+z_1$ | $\ldots z_{D,1}=z_{A,1}+z_{AD}+z_1$ |
| | $=z_0+z_L+z_S+z_{AB}+z_1$ | $\ldots\ =z_0+z_L+z_S+z_{AD}+z_1$ |
| | . | . |
| | . | . |
| | . | . |
| $z_{A,i}=z_0+i(z_L+z_S)+z_1$ | $z_{B,j}=z_0+z_{AB}+j(z_L+z_S)+z_1$ | $\ldots\ z_{D,l}=z_0+z_{AD}+l(z_L+z_S)+z_1$ |

Comparator means 72 continuously compares the values $z_{A,i}\ldots z_{D,l}$, wherein i, j, k and l start at 0 and stop at N−1, with the value z and, when match(es) are encountered generates signal(s) $s_A$ to $s_D$ after which the respective value(s) i to l are incremented.

Image writing stations 73, upon receipt of the trigger signal(s) $s_A$ to $s_D$, start the writing of the image at image writing station(s) A to D. Once the writing of an image has started, the rest of the image is written with a line frequency $f_D$ derived from $$f_D=f_E/n,$$

the frequency $f_D$ thus being in synchronism with the encoder output, the phase of which is zeroed at the receipt of the trigger signal.

The above described mechanism is of course not restricted to control only the registration of the different images on the paper, but can also be used for generating accurate web-position aware signals for any module in the printer. Examples of such modules are the cutter station 20, the stacker 52 (see FIG. 2).

Figure 8A:
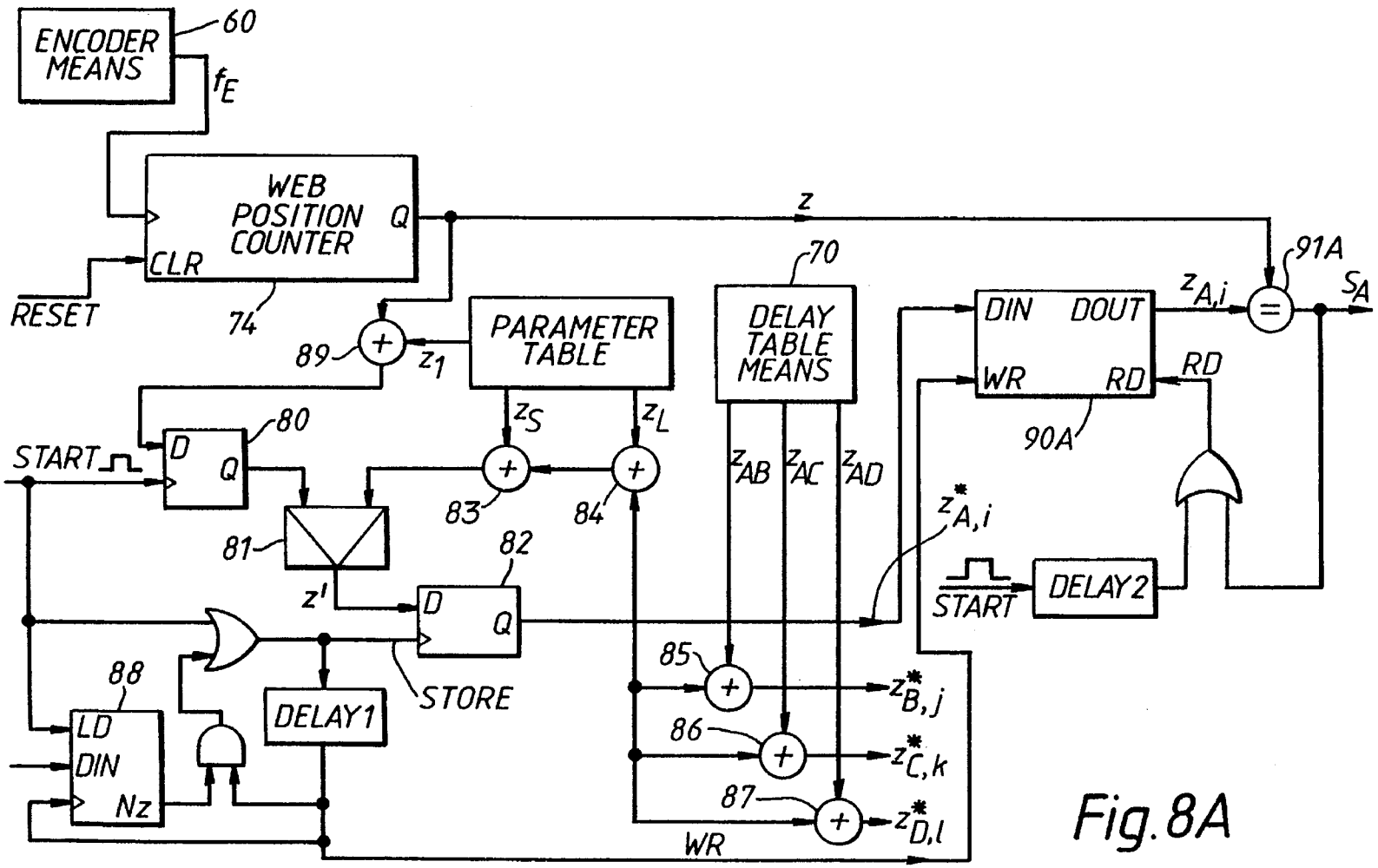
FIGS. 8A and 8B show in detail one embodiment of the control circuit for controlling the registration of images in a printer according to the invention, the figure being shown in two parts.
Figure 8B:
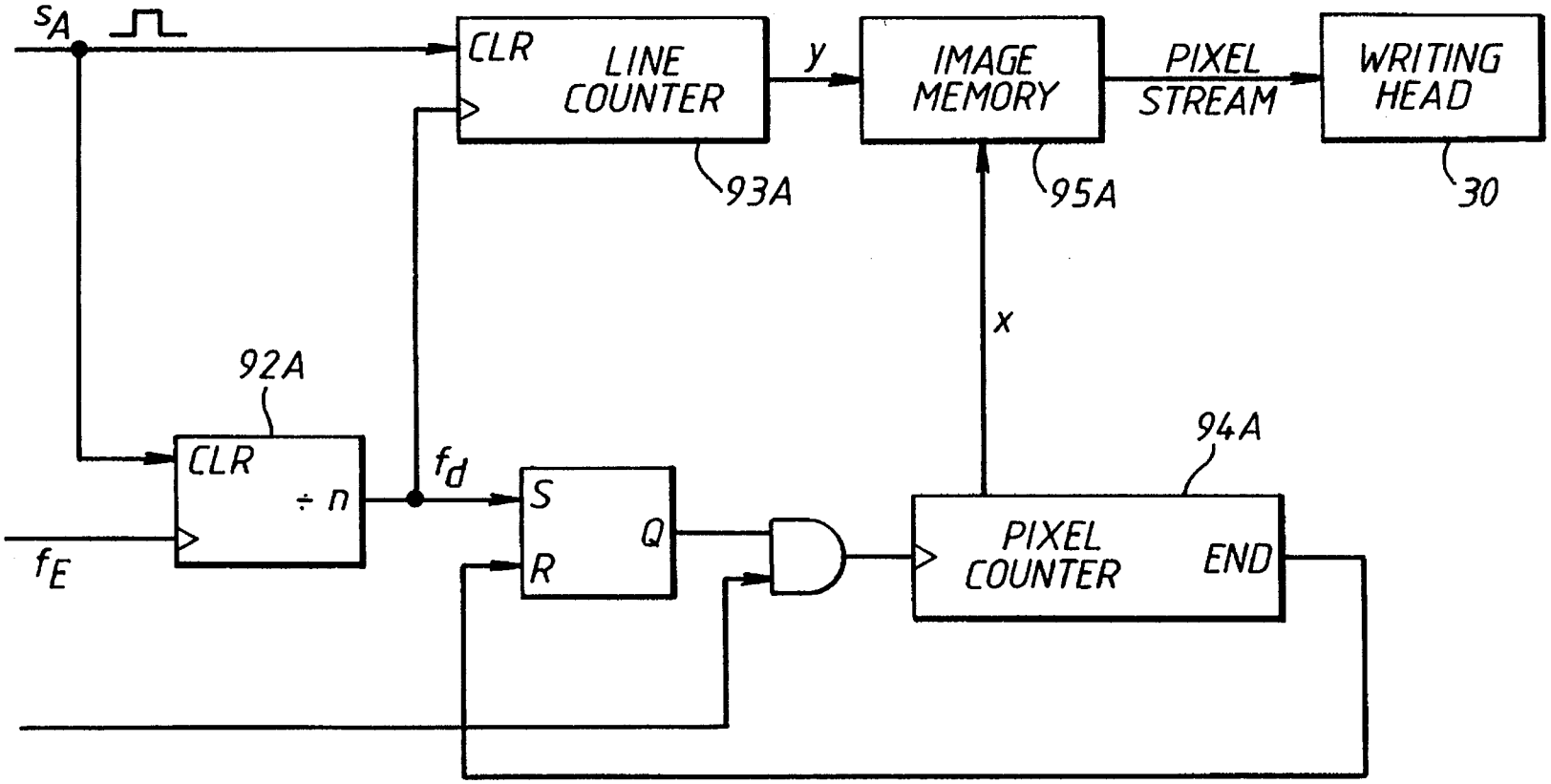

Referring to FIGS. 8A and 8B, when the START pulse initiating the printing cycle is asserted, register 80 stores the sum $z_0+z_1$, as calculated by means of adder 89. Multiplexer 81 feeds this value through to register 82. Adders 85, 86 and 87 then calculate $z^*_{B,j}$, $z^*_{C,k}$ and $z^*_{D,l}$, with j, k and l being zero, being the scheduled web positions at which writing of the first image on the respective image transfer station should start, $z^*_{A,i}$, with i being zero, of course being equal to $z_0+z_1$. After a period of time equal to delay 1, these values are stored in the FIFO (first-in, first-out) memories 90A, 90B, 90C and 90D, of which for simplicity only FIFO 90A is shown. Meanwhile, adders 83 and 84 have calculated $z^*_{A,1}$ being $z^*_{A,0}+z_L+z_S$, and this value is fed through multiplexer 81 to register 82. Again, adders 85, 86 and 87 will then calculate from $z^*_{A,1}$ the values $z^*_{B,1}$, $z^*_{C,1}$ and $z^*_{D,1}$ which are again stored in the FIFO's 90A etc. This process continues until down-counter 88, which started at the value N and decrements with every write pulse storing a next series of values $z^*_{A,i}$ to $z^*_{D,l}$ into the FIFO's, reaches zero. When this has happened, all positions at which writing of an image should start are calculated and stored, in chronological order, in the FIFO memories.

Meanwhile, comparators 91A etc. are continuously comparing the web position z to the values $z_{A,i}$ to $z_{D,l}$, where i to l are initially zero, as read from the FIFO's. When z equals $z_{A,0}$, the signal $s_A$ is asserted, which resets divider 92A (see FIG. 8B), thus synchronising the phase of the $f_D$ signal with the $s_A$ pulse for reasons of increased sub-line registration accuracy as explained above. Also line counter 93A is cleared which addresses line y=0 in the image memory 95A. For every pulse of the $f_D$ signal, pixel counter 94A produces an up-counting series of pixel addresses x. As the image memory is organised as a two-dimensional array of pixels, the counting pixel address x, at the rate specified by the signal PIXEL-CLK (pixel clock), produces a stream of pixel values which are fed to the writing head 30 resulting in a line-wise exposure of the photoconductive drum surface 26. For every n pulses of the $f_E$ signal, a next line of pixels is fed to the writing heads. In this way the registration of the different images is not only accurate at the beginning of the image, but it also stays accurate within the image.

As soon as the writing of an image has started, the $s_A$ to $s_D$ signals will cause the next $z_{A,i}$ to $z_{D,l}$ value to be read from the FIFO memory 90A etc. so that the next copy of the image will be started as scheduled.

Figure 9:
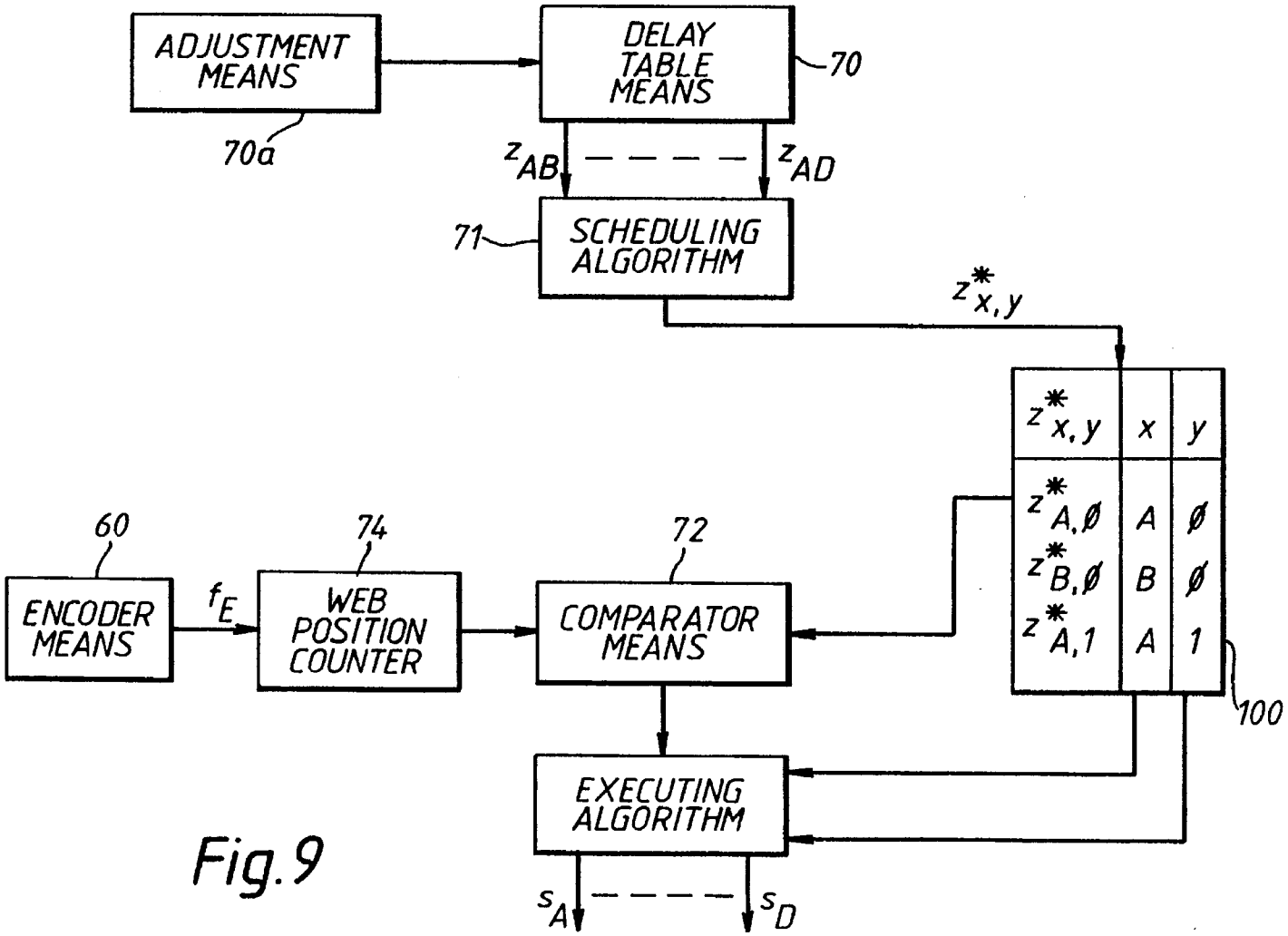
FIG. 9 shows an alternative embodiment of a control circuit for controlling the registration of images in a printer according to the invention.

In the more preferred embodiment of the invention shown in FIG. 9, substantial parts of the control circuit are implemented by means of a software program being executed on a microprocessor chip. In this case, all functions offered by the electronic circuit of FIG. 8A, except for the encoder means, are replaced by a software code, thereby increasing the flexibility of the control circuit.

The calculated values $z^*_{A,i}$ to $z^*_{D,l}$ are preferably stored in one or more sorted tables 100 in the microprocessor's memory. As in the hardware solution, a comparator means 72 continuously compares the first entry in this list with the web position z as given by a web position counter 74, which is preferably software but possibly hardware assisted. Upon detection of a match between the two values, the microprocessor asserts the respective signal $s_A$ to $s_D$.

In order to calibrate the register means, the operator makes a test print, the print is examined and any misregistration error Δ is measured. A pulse number correction, equal to Δ/ρ is then added or subtracted from the values $z_{AB}$ etc. stored in the delay table 70 by the adjustment means 70*a*, using methods well known in the art.

Figure 10:
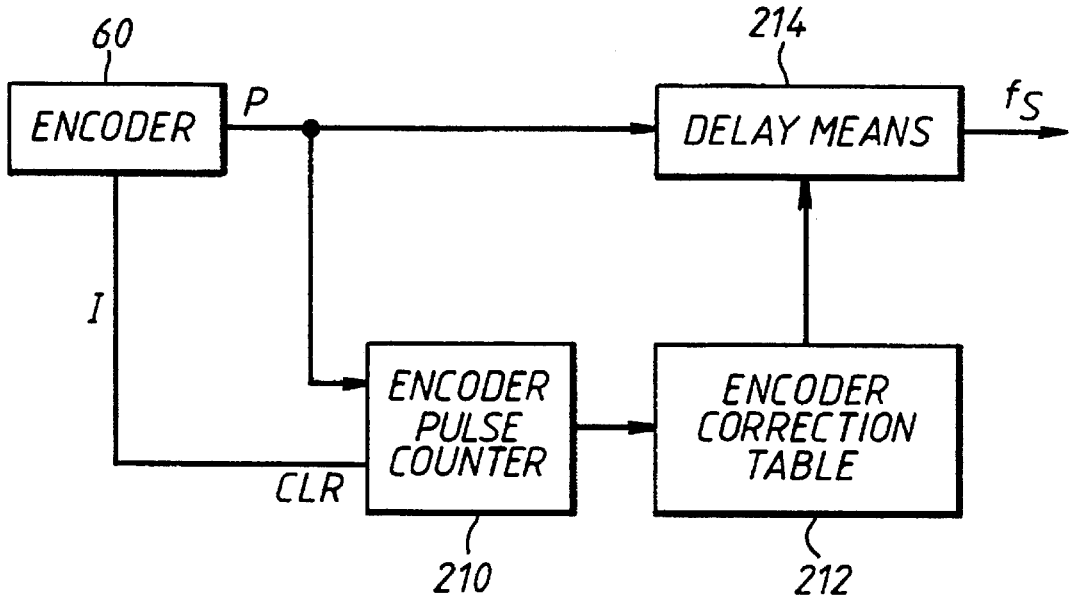
FIG. 10 shows a schematic arrangement of a preferred embodiment of the encoder correction means.

Referring to FIG. 10, in order to correct the period of each individual pulse output from the encoder sensor means 60, the encoder means 60 produces an additional signal I which acts as an index for the encoder signal P. When the encoder sensor means 60 comprises a disc with a plurality of spaced markings, which are sensed by a first optical sensor, thereby producing pulses that are indicative of web displacement, the signal I is generated by means of a second optical sensor, so that for every revolution of the encoder disc, a single pulse is generated. As such the encoder pulse counter 210 identifies, using the index pulse as a reference, by means of a multi-bit signal, each pulse P produced by the first optical sensor. In the encoder correction table 212, which is preferably contained in some form of non-volatile memory such as a programmable read-only memory (PROM), are stored predetermined multi-bit period time correction values for each of the individual encoder pulses P. In order to allow the encoder correction means to decrease the period time of a certain pulse, such period time correction values are the sum of a positive fixed time and a positive or negative corrective time. Delay means 214 will delay every pulse output from the first encoder sensor by a time equal to the predetermined correction time received from the encoder correction table 212 thus producing a corrected encoder signal $f_s$.

Figure 11:
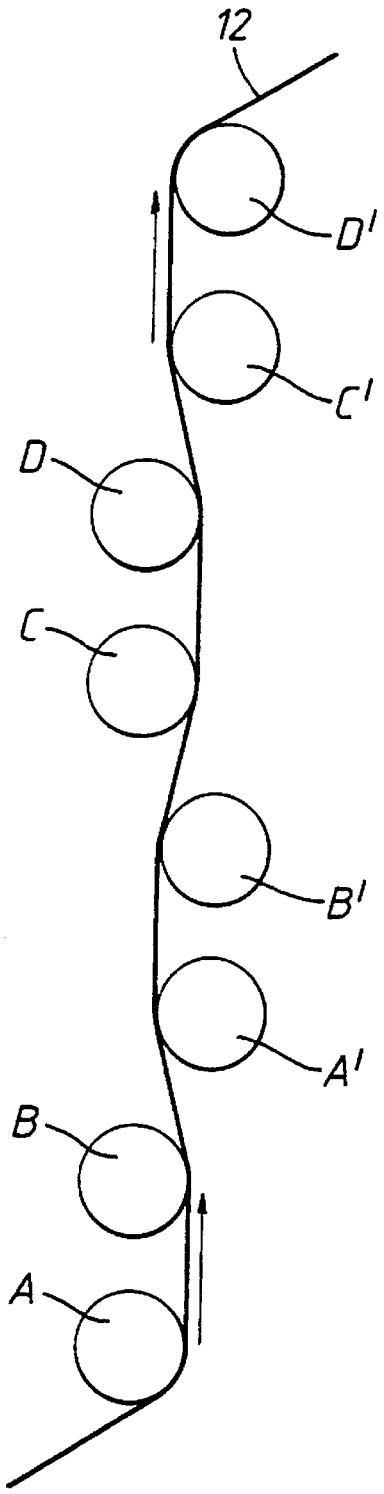
FIG. 11 shows an alternative arrangement of printing stations for use in a printer according to the invention.

FIG. 11 shows a different arrangement of printing stations A to D and A' to D' relative to the path of the web 12. The operation of this arrangement will be clear to those skilled in the art. The stations may be arranged in a horizontal, vertical or other configuration.

CROSS-REFERENCE TO CO-PENDING APPLICATIONS

A number of features of the printers described herein are the subject matter of the following co-pending U.S. patent application Nos. 08/257,112 entitled "Electrostatographic single-pass multiple-station printer"; No. 08/257,111 entitled "Electrostatographic single-pass multiple station printer with register control"; No. 08/257,046 entitled "Paper receptor material conditioning apparatus"; No. 08/257,048 entitled "Electrostatographic printer for forming an image onto a receptor element", all filed on Jun. 8, 1994.

What is claimed is:

1. An electrostatographic single-pass multiple station printer for forming images on a web, which printer comprises:

at least three toner image-producing electrostatographic stations each having rotatable endless surface means onto which a toner image can be formed;

means for conveying said web in succession past said stations;

transfer means for transferring said toner image on each rotatable surface means onto said web, wherein said image-producing stations are arranged in two sub-groups, said rotatable surface means of one sub-group being staggered with respect to said rotatable surface means of the other sub-group, thereby to enable simultaneous duplex printing.

2. A printer according to claim 1, wherein said image-producing stations are located one by one alternately on opposite sides of said web.

3. A printer according to claim 2, further comprising means for controlling the electrostatic charge polarity of toner already present on said web in advance of the third and each subsequent image-producing station, to enable the transfer of a toner image at the third and any subsequent image-producing station without disturbing the image transferred to the same side of said web at a previous image-producing station.

4. A printer according to claim 2, wherein:

the toner images transferred to said web in each image-producing station have the same charge polarity; and there is provided between neighbouring image-producing stations from the second image-producing station onwards, means for restoring the polarity of toner already deposited on one side of said web before arriving at a following image-producing station after having passed said transfer means of the preceding station.

5. A printer according to claim 4, comprising more than three of said image-producing stations, means for restoring the polarity of the toner image being provided between the second and third and between each subsequent pair of said image-producing stations.

6. A printer according to claim 4, wherein said means for restoring the polarity of the toner image comprises a corona charging device.

7. A printer according to claim 6, wherein said corona charging device comprises an alternating current corona having a net charging output of a polarity equal to the original charge polarity of the toner to be transferred at the next developing station.

8. A printer according to claim 7, wherein said alternating current corona is located on the opposite side of the web path to a positive direct current corona.

9. A printer according to claim 1, wherein an alternating current web-discharge corona is provided beyond said transfer means to discharge said web and thereby allow said web to become released from said rotatable endless surface means.

10. A printer according to claim 1, wherein said rotatable endless surface means is selected from a drum and a belt.

11. A printer according to claim 10, wherein said rotatable endless surface means has a photoconductive surface.

12. A printer according to claim 11, wherein each said toner image-producing electrostatographic station comprises:

means for charging the surface of said rotatable endless surface means;

means for image-wise exposing the charged surface of said rotatable endless surface means; and a development station for depositing toner onto the photo-discharged areas of the surface of said rotatable endless surface means.

13. A printer according to claim 12, wherein said development station contains a mixture of toner particles and conductive carrier particles.

14. A printer according to claim 13, wherein said development station contains means for forming a magnetic brush of magnetically attracted toner-laden carrier particles.

15. A printer according to claim 12, wherein said means for image-wise exposing the charged surface of said rotatable endless surface means comprises an array of image-wise modulated light-emitting diodes.

16. A printer according to claim 1, wherein said stations of each sub-group are arranged in a substantially vertical configuration.

17. A printer according to claim 1, wherein said printer comprises a heating means for fixing the toner images after the transfer thereof to both sides of the web.

18. A printer according to claim 1, wherein said printer comprises a cutting station for cutting the printed web into sheets.

19. A printer according to claim 18, further comprising a heating means for fixing the toner image to said web is located in advance of said cutting station.

20. A printer according to claim 1, wherein said web is fed from a roll.

21. A printer according to claim 1, further comprising means for conveying said web under tension past said image-producing stations in synchronism with the rotation of said rotatable surface means.

22. A printer according to claim 21, wherein the adherent contact of said web with said rotatable endless surface means is capable of allowing the moving web to control the rotation speed of said surface means in synchronism with the movement of said web.

23. A printer according to claim 22, wherein each image-producing station comprises a driven rotatable magnetic brush and a driven rotatable cleaning brush, both in frictional contact with said rotatable endless surface means, said brushes rotating in opposite sense.

24. A printer according to claim 23, wherein the peripheral speeds of said magnetic brush and said cleaning brush and their respective extent of frictional contact with said rotatable endless surface means are such that the resultant force transmitted to said rotatable endless surface means is substantially zero.

25. A printer according to claim 23, wherein the position of at least one of said brushes relative to said rotatable endless surface means is adjustable thereby to adjust the extent of frictional contact between that brush and said rotatable endless surface means.

26. A printer according to claim 1, further comprising a rotatable contact roller for contacting said web while it has an electrostatically charged toner particle image on at least that surface thereof which is adjacent said contact roller, wherein said contact roller is associated with electrostatic charging means capable of providing on the surface of said contact roller an electrostatic charge having the same polarity as the charge polarity of the toner particles on the adjacent surface of said web before contact of said web with the surface of said contact roller.

* * * * *